US011495426B2

(12) United States Patent
Manfreda

(10) Patent No.: US 11,495,426 B2
(45) Date of Patent: Nov. 8, 2022

(54) ELECTROMAGNETIC SWITCH FOR A STARTING DEVICE

(71) Applicant: Mahle International GmbH, Stuttgart (DE)

(72) Inventor: Dejan Manfreda, Kal nad Kanalom (SI)

(73) Assignee: Mahle International GmbH, Stuttgart (DE)

( * ) Notice: Subject to any disclaimer, the term of this patent is extended or adjusted under 35 U.S.C. 154(b) by 300 days.

(21) Appl. No.: 16/551,699

(22) Filed: Aug. 26, 2019

(65) Prior Publication Data

US 2020/0075279 A1 Mar. 5, 2020

(51) Int. Cl.

| | |
|---|---|
| ***H01H 50/54*** | (2006.01) |
| ***H01H 50/44*** | (2006.01) |
| ***F02N 11/08*** | (2006.01) |
| ***H01H 50/20*** | (2006.01) |
| ***H01H 50/42*** | (2006.01) |

(52) U.S. Cl.

CPC ..... *H01H 50/44* (2013.01); *F02N 11/087* (2013.01); *H01H 50/20* (2013.01); *H01H 50/42* (2013.01); *F02N 2011/0874* (2013.01)

(58) Field of Classification Search

CPC ..... H01H 50/44; H01H 50/20; H01H 50/42; H01H 50/163; H01H 2050/446; H01H 51/065; H01H 50/02; H01H 50/16; H01H 50/443; F02N 11/087; F02N 2011/0874; F02N 15/067; F02N 11/0859; F02N 2011/0892; H01F 7/1607; H01F 27/2823;

(Continued)

(56) References Cited

U.S. PATENT DOCUMENTS 3,699,486 A * 10/1972 De Lucia ..... H01H 51/28 335/131
3,815,060 A * 6/1974 Turnbull ..... H01H 50/546 335/133

(Continued)

FOREIGN PATENT DOCUMENTS

DE 10 2009 052 938 A1 11/2010
DE 102009027117 A1 12/2010

(Continued)

OTHER PUBLICATIONS

English abstract for DE-102009027117.

*Primary Examiner* — Shawki S Ismail
*Assistant Examiner* — Lisa N Homza
(74) *Attorney, Agent, or Firm* — Fishman Stewart PLLC

(57) ABSTRACT

An electromagnetic switch for a starting device of an internal combustion engine may include a coil carrier, a coil winding, and a piston. The coil carrier may have a carrier wall which encloses a cavity. The coil winding may have a coil wire wound on a side of the carrier wall facing away from the cavity which provides a magnetic field within the cavity. The piston may be axially adjustable in the cavity. The piston may be disposed in a passive position and may be adjusted axially in a direction of a core. In the passive position, the piston and the core may define an axial gap therebetween in the cavity. The coil wire may have a first winding section and a second winding section wound in opposing directions. At least one winding of the second winding section may axially overlap the axial gap.

20 Claims, 11 Drawing Sheets

(58) Field of Classification Search
CPC .. H01F 27/2866; H01F 2005/022; H01F 5/02; H01F 27/306
USPC ..... 335/2
See application file for complete search history.

(56) References Cited

U.S. PATENT DOCUMENTS 4,987,396 A * 1/1991 Bogner ..... H01H 1/2083 335/126
5,481,236 A * 1/1996 Ruehle ..... H01H 51/065 335/126
5,677,656 A * 10/1997 Mauch ..... H01H 51/065 335/126
6,360,707 B1 * 3/2002 Boegner ..... F02N 11/087 123/179.25
6,911,884 B2 * 6/2005 Uotome ..... H01H 47/08 335/132
6,930,576 B2 * 8/2005 Usami ..... F02N 15/067 335/126
6,937,123 B2 * 8/2005 Imanishi ..... F02N 15/067 335/126
6,943,654 B2 * 9/2005 Zhou ..... H01H 9/563 335/106
7,859,373 B2 * 12/2010 Yamamoto ..... H01H 50/305 335/126
8,138,872 B2 * 3/2012 Yoshihara ..... H01H 51/2209 335/281
8,179,217 B2 * 5/2012 Kawaguchi ..... H01H 50/20 335/80
8,248,193 B2 * 8/2012 Kaneda ..... F02N 15/067 335/126
8,653,913 B2 * 2/2014 Vellaiyanaicken .. H01H 1/2025 335/126
8,674,796 B2 * 3/2014 Ito ..... H01H 50/546 335/260
8,729,984 B2 * 5/2014 Feller ..... H01H 71/2463 335/119
9,177,744 B2 * 11/2015 Biessenberger ..... H01H 51/065
9,183,974 B1 * 11/2015 Folker ..... H01F 27/306
2010/0231342 A1 * 9/2010 Zeng ..... H01F 27/006 336/192
2011/0260562 A1 10/2011 Bradfield
2013/0021121 A1 * 1/2013 Uchida ..... H01H 51/065 335/131
2013/0021122 A1 * 1/2013 Uchida ..... H01H 1/54 335/131
2013/0342291 A1 * 12/2013 Turnback ..... H01H 50/00 335/177
2014/0240067 A1 8/2014 Santichen et al.

FOREIGN PATENT DOCUMENTS

EP 2677161 A2 12/2013
EP 3 131 101 A1 2/2017
EP 3131101 A1 * 2/2017

* cited by examiner

ELECTROMAGNETIC SWITCH FOR A STARTING DEVICE

CROSS-REFERENCE TO RELATED APPLICATIONS

This application claims priority to European Patent Application No. EP 18191247.8, filed on Aug. 28, 2018, the contents of which are hereby incorporated by reference in its entirety.

TECHNICAL FIELD

The present invention relates to an electromagnetic switch for a starting device, which electromagnetic switch has a coil carrier onto which a coil wire of a coil winding is wound. The invention furthermore relates to a starting device having a switch of said type.

BACKGROUND

For the starting of internal combustion engines, use is commonly made of starting devices. A starting device of said type commonly has a starting element, for example a pinion, which, for the starting of the internal combustion engine, is placed in engagement with a counterpart starting element of the internal combustion engine, for example a ring gear, and drives the latter in order to start the internal combustion engine.

A starting device of said type is known, for example, from DE 10 2009 052 938 A1. The starting device has an electromagnetic switch which has a coil carrier with a holding coil and an adjustment coil wound thereon, which coils are each wound from a coil wire around the coil carrier. During operation, the coils generate a magnetic field within the coil carrier, which magnetic field adjusts a ferromagnetic piston within the coil carrier in the direction of a core. The starting device furthermore has a drive motor which transmits a torque via a pinion to a ring gear of an internal combustion engine in order to start the internal combustion engine. The pinion is placed in engagement with the ring gear, and removed from such engagement, by means of the electromagnetic switch. The electromagnetic switch and the drive motor are in this case connected electrically in series, such that an electrical current flows through the coils in order to generate the magnetic field and subsequently to the drive motor in order to drive the latter.

In the case of such starting devices, it is desirable for sufficient torque for starting the internal combustion engine to be provided. This is normally realized by means of an increase of the electrical current supplied to the drive motor, which in turn leads to a stronger magnetic field in the coil carrier and thus to an increased adjustment force of the piston and ultimately of the pinion in the direction of the ring gear. This increased adjustment force however leads to more intense striking of the pinion against the ring gear, which can lead to damage to the pinion and/or to the ring gear.

It is furthermore desirable for the coil geometry of the electromagnetic switch to be left as far as possible unchanged.

To weaken the magnetic field generated within the coil carrier by means of the coils, DE 10 2009 052 938 A1 proposes that a ferromagnetic bypass body be provided on the coil carrier, which bypass body weakens the magnetic field generated within the coil body by the coils. This has the result that smaller structural spaces are available for the coil winding if it is sought to maintain an unchanged overall geometry. Said document also mentions winding a part of the coil winding in an opposite direction in relation to the rest of the coil winding.

US 2014/0240067 A1 proposes that the piston within the coil carrier be equipped with an encircling groove in order to reduce the influence of the magnetic field on the piston. The non-uniform profile of the shell surface of the piston however leads to non-uniform sliding of the piston within the coil carrier. Furthermore, the maximum possible dimensions of the groove are limited, such that a small reduction of the adjustment force is possible.

From US 2011/0260562 A1, it is known for a lug to be attached to the outside of a coil carrier of an electromagnetic switch, along which lug a coil wire of the coil winding is guided in order for the coil wire to be wound in opposite directions on mutually averted sides of the lug.

EP 3 131 101 A1 has disclosed a coil carrier which, on the outside, is equipped with an encircling separating body with a recess in order for the associated coil wire to be able to be guided through the recess and wound in opposite directions.

SUMMARY

The present invention is concerned with the problem of specifying, for an electromagnetic switch of the above-stated type, and for a starting device having an electromagnetic switch of said type, improved or at least alternative embodiments which are distinguished in particular by an efficient reduction of the magnetic force acting on the piston and/or by a small structural space requirement.

Said object is achieved according to the invention by means of the subjects of the independent claim(s). The dependent claim(s) relate to advantageous embodiments.

The present invention is based on the general concept whereby, in a passive position of a piston of the switch, at least one winding of a coil winding of an electromagnetic switch is arranged in the region of a gap between the piston and a core of the switch, and said at least one winding is wound in the opposite direction in relation to the rest of the coil winding. Here, the passive position of the piston corresponds to the position of the piston in the absence of the action of the magnetic field generated by the coil winding. As a result, the weakening of the magnetic field achieved by means of the winding wound in the opposite winding direction is always realized in a region relevant for the adjustment of the piston. Thus, the magnetic field acting on the piston, and the magnetic force or magnetic flux exerted by said magnetic field, is locally reduced in a relevant region. This is in particular also realized with an otherwise unchanged geometry of the switch, in particular of the coil winding, and of the electrical currents through the coil winding, such that firstly, the reduction of the magnetic field is realized in a structural-space-saving manner, and secondly, an effective reduction of the magnetic force that acts on the piston for the purposes of adjusting the piston, hereinafter also referred to as adjustment force, is realized. Furthermore, the electrical energization of the electromagnetic switch, in particular of the coil winding, can be maintained, such that subsequent applications, in particular a supply of electricity to a downstream motor of an associated starting device for an internal combustion engine, remains unchanged, or, in the case of a reduced adjustment force on the piston, can be increased, such that it remains possible for an equal or increased torque to be transmitted by means of the motor. Said torque is commonly transmitted by means of a starting element of the associated starting device for starting the internal combustion engine to a counterpart starting element of the internal combustion engine, such that the torque required for the starting process remains constant, while the adjustment of the starting element in the direction of the counterpart starting element is reduced, and thus damage to starting element and counterpart starting element is prevented or at least reduced. Secondly, the torque can be increased, without the adjustment force being correspondingly increased.

In accordance with the concept of the invention, the electromagnetic switch has a coil carrier which has a carrier wall extending in an axial direction, which carrier wall encloses a cavity in the coil carrier. The carrier wall is thus in particular of cylindrical form. The piston is arranged in axially adjustable fashion in the cavity of the coil carrier. The coil winding is a coil wire wound on that side of the carrier wall which is averted from the cavity, or said coil winding has a wound coil wire of said type. During operation, the coil winding is flowed through by an electrical current and thereby generates a magnetic field within the cavity, which magnetic field adjusts the piston axially in the cavity. The piston is designed correspondingly for this purpose, for example is at least partially ferromagnetic. Here, the magnetic field generated by the coil winding adjusts the piston in the direction of a core, which is preferably axially fixed and in particular accommodated in the cavity. When the coil winding is not in operation, the piston is situated in a passive position. In said passive position, an axial gap is formed, in the cavity, between the piston and the core in an axial direction. The coil wire is wound in at least two winding sections in opposite winding directions. That is to say, the coil wire is, in a first axial winding section, wound in a first winding direction around the carrier wall. The first winding direction is that which serves for generating a magnetic field for the purposes of adjusting the piston in the direction of the core. In a second axial winding section, the coil wire is furthermore wound in a second winding direction around the carrier wall, wherein the second winding direction is opposite to the first winding direction. According to the invention, at least one winding of the second winding section is arranged so as to axially overlap the axial gap.

In the present case, the stated directions relate to the axial direction. Here, axial means in the axial direction or parallel to the axial direction. Radial direction, and radial, mean perpendicular to the axial direction or perpendicular to the axial. The circumferential direction is also to be understood in relation to the axial direction or axial.

The expression or the feature "axial gap" is to be understood in the present case as the axially running gap between the piston and the core in the passive position of the piston.

It is preferable if all of the windings of the second winding section axially overlap the axial gap. It is thus possible to realize a particularly effective reduction of the magnetic field acting on the piston, and thus a particularly effective reduction of the adjustment force of the piston.

The first winding section is expediently that section of the coil winding which is wound in the first winding direction and which extends axially. By contrast, the second winding section is that section of the coil winding in which the coil wire is wound in the second winding direction and extends axially. It is also possible for the second winding section to extend across multiple radially successive rows 31 of the coil winding 13.

The piston is, in the associated starting device, preferably coupled to the starting element, in particular to a pinion, of the starting device such that an adjustment of the piston in the direction of the core leads to an adjustment of the starting element in the direction of a counterpart starting element of an associated internal combustion engine, in particular in the direction of a ring gear. The adjustment force of the piston thus correlates with an adjustment force of the starting element axially in the direction of the counterpart starting element.

Here, the starting element is advantageously driven by an electrically operated motor of the starting device such that said starting element exerts a torque on the counterpart starting element when the starting element is in engagement with the counterpart starting element.

The piston is advantageously equipped with a switching element which, during the adjustment in the direction of the core, produces a supply of electricity to the motor, as described for example in DE 10 2009 052 938 A1.

It is preferable if the second winding section axially and/or radially, in particular directly, adjoins the first winding section. That is to say, the coil wire transitions directly from the first winding section into the second winding section. The coil winding can thus be realized in structural-space-saving form.

The switch may in principle have multiple coil windings or coils. In particular, the switch may have an attracting coil for adjusting the piston in the direction of the core and a holding coil for holding the core in one position. The coil winding described here is preferably the attracting coil.

Embodiments are particularly preferred in which the coil wire is, in a third axial central section, wound in the first winding direction around the carrier wall, wherein the second winding section is arranged axially between the first winding section and the third winding section. In particular, the third winding section axially, advantageously directly, adjoins the second winding section. It is thus possible for the second winding section, which is wound in the opposite winding direction in order to reduce the magnetic field within the coil body, to be arranged locally in targeted fashion in order to realize the weakening of the magnetic field locally in the region of the axial gap.

The third winding section corresponds in particular to the first winding section, with the difference that, in the at least one row in which the second winding section is arranged, the first winding section and the third winding section are arranged on axially mutually averted sides of the second winding section.

It is preferable if the at least one winding of the second winding section which axially overlaps the axial gap is arranged radially as close as possible to the axial gap. This means in particular that the at least one winding is, at least in the axial region in which it is situated, the winding arranged radially closest to the cavity. In other words, the side, which faces radially toward the axial gap, of the at least one winding, which axially overlaps the axial gap, of the second winding section is free from the coil wire. In other words, radially between the at least one winding of the second winding section, preferably the entire second winding section, and the axial gap, there are arranged no other windings of the coil wire. This leads to a particularly efficient weakening of the magnetic field within the cavity, in particular within the axial gap.

Embodiments have proven to be advantageous in which that side of the first winding section which is axially averted from the second winding section is free from windings of the coil wire. This means in particular that the first winding section extends from a first axial end of the coil carrier to the second winding section. It is likewise preferable if that side of the third winding section which is axially averted from the second winding section is free from windings of the coil wire. This means in particular that the third winding section may extend from a second axial end of the coil carrier to the second winding section.

It is advantageous if the carrier wall has a radial step, such that, in a first wall section, said carrier wall has an outer diameter which is smaller than the outer diameter in a second wall section that axially follows the first wall section. Thus, in the first wall section, a depression or a chamber running in the direction of the cavity is formed. The chamber is preferably filled with the first winding section, whereas the second winding section is wound on the second wall section. The third winding section, if provided, is advantageously also wound on the second wall section. Here, the first wall section is preferably arranged closer to the core than the second wall section, such that the chamber is also arranged axially closer to the core, in particular so as to axially overlap the core, whereas the second winding section is arranged axially closer to the piston, in particular so as to be axially spaced apart from the core. The filling of the chamber with the first winding section has the effect in particular that a stronger magnetic field is generated in the region of the chamber than at an axial distance from the chamber, such that, altogether, there is a non-uniform distribution of the magnetic field, which leads to a reduction of the adjustment force of the piston.

In principle, it is conceivable for the coil wire to be wound only in a single axially running row around the carrier wall.

It is also conceivable for the coil wire to be wound in at least two radially successive rows around the carrier wall. This means in particular that the coil wire may have multiple rows. Here, the second winding section is preferably arranged in the first row radially adjoining the carrier wall, that is to say so as to be radially as close as possible to the axial gap. In particular, the second winding section is arranged exclusively in one row, and is axially limited.

It is preferable for at least two rows of the first winding section to be wound in the chamber, wherein the coil wire subsequently transitions into the second winding section. The second winding section may be followed, in the row of the second winding section, by the third winding section.

Embodiments have proven to be advantageous in which a pitch of the coil wire in the second winding section, that is to say a density of coil wire in the second winding section or an axial spacing of the coil wire in the second winding section, varies. This means in particular that the second winding section has an axially non-uniform distribution of coil wire. In this way, a more targeted weakening of the magnetic field within the cavity, in particular within the axial gap, and thus a more targeted reduction of the adjustment force of the piston, can be realized.

It is advantageous if the pitch of the coil wire in the second winding section decreases axially toward the core. In other words, the coil wire in the second winding section is wound more densely axially toward the core. This means that the magnetic field is more intensely weakened axially in the direction of the core. In this way, in particular, the magnetic flux which increases with decreasing axial spacing between piston and core is compensated.

In principle, the coil wire may have identical magnetic characteristics along its entire extent.

Embodiments are advantageous in which the coil wire has a first wire section which is not ferromagnetic, for example is produced from Cu, Al and the like, and a second wire section, which is ferromagnetic, for example is produced from Fe, Ni and the like. In this way, it is also possible within the coil wire, by means of the induction of magnetic fields, to achieve a targeted weakening of the magnetic field within the cavity and thus of the adjustment force of the piston.

The different wire sections are in this case preferably coherent or uninterrupted. Here, the second wire section may follow the first wire section and vice versa. Multiple first and/or second wire sections are also conceivable.

At least one of the at least one windings of the second winding section that axially overlaps the axial gap is preferably formed by the ferromagnetic second wire section of the coil wire. In this way, an additional local weakening of the magnetic field in the cavity is realized in addition to the weakening already effected by the opposite winding direction.

It is advantageous if the entire second winding section is formed by the ferromagnetic second wire section.

It is also conceivable for the second winding section to be formed by the first wire section and by the second wire section.

Embodiments are preferable in which firstly the ferromagnetic second wire section of the coil wire is wound onto the carrier wall, and subsequently the non-ferromagnetic first wire section. This means in particular that at least a first radial row of the coil winding is formed by the ferromagnetic second wire section. It is particularly preferable here if the second winding section is arranged in the first row. In this way, a particularly effective and intense reduction of the magnetic field in the cavity, in particular in the axial gap, can be realized.

Embodiments have proven to be advantageous in which the second ferromagnetic wire section is spaced apart axially from the core. Thus, a reduction of the magnetic field or of the magnetic flux in the region of the core is limited, such that, in particular, the holding of the piston when the piston reaches a position in the vicinity of the core can be simplified, and reliably implemented, for example by means of a holding coil.

The ferromagnetic second wire section may be wound on the first wall section and thus arranged within the chamber. It is thus possible in particular for an axial spacing between the ferromagnetic second wire section and the core to be realized if the chamber is spaced apart axially from the core.

For the further reduction of the magnetic field or flux in the cavity, the electromagnetic switch may have a ferromagnetic bypass body, which encloses the cavity and which is arranged radially between the cavity and the coil winding. The bypass body leads in particular to a diversion of the magnetic flux and thus to a reduction of the magnetic field in the cavity. Here, it is advantageously the case that, in the passive position of the piston, the bypass body is arranged so as to axially overlap the axial gap. It is particularly preferable if, furthermore, at least one winding of the second winding section axially overlaps the bypass body. It is particularly advantageous for both the second winding section and the bypass body to axially overlap the axial gap. It is thus possible to realize a particularly effective, local reduction of the magnetic field within the cavity.

In principle, it is possible for only an axial subsection of the bypass body to axially overlap the axial gap. It is likewise conceivable for the bypass body to axially entirely overlap the axial gap. That is, the entire axial length of the bypass body can be in axial overlap with the axial gap.

The bypass body is preferably axially spaced apart from the core. In this way, a magnetic flux from the bypass body to the core is prevented or at least reduced. Consequently, a more effective weakening of the magnetic field between the piston and the core is achieved. An axial distance or clearance between the bypass body and the core is preferably at least 2 mm.

It is self-evident that the subject matter of this invention encompasses not only the electromagnetic switch but also a starting device having an electromagnetic switch of said type.

Further important features and advantages of the invention will emerge from the subclaims, from the drawings and from the associated Figure description based on the drawings.

It is self-evident that the features mentioned above and the features yet to be discussed below may be used not only in the respectively specified combination but also in other combinations or individually without departing from the scope of the present invention.

Preferred exemplary embodiments of the invention are illustrated in the drawings and will be discussed in more detail in the following description, wherein identical reference designations relate to identical or similar or functionally identical components.

BRIEF DESCRIPTION OF THE DRAWINGS

In the drawings, in each case schematically.

DETAILED DESCRIPTION

Figure 7:
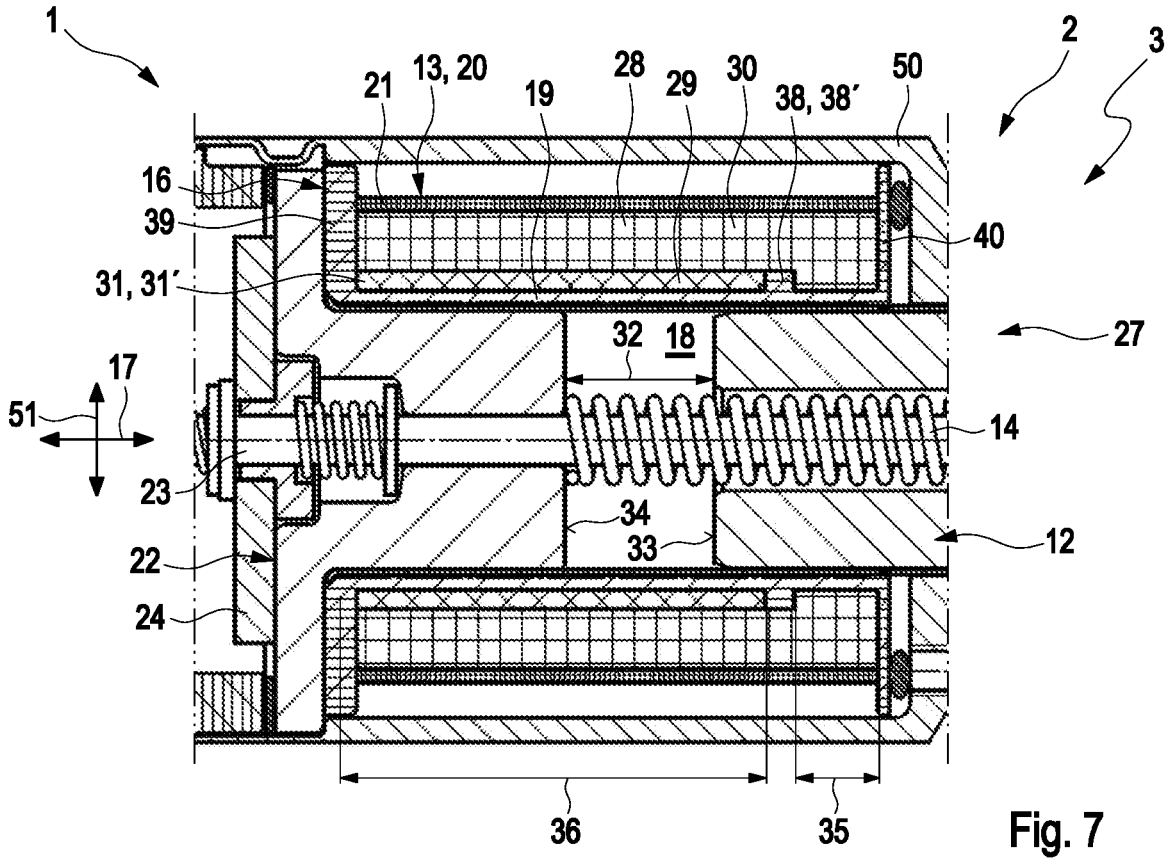
Figure 8:
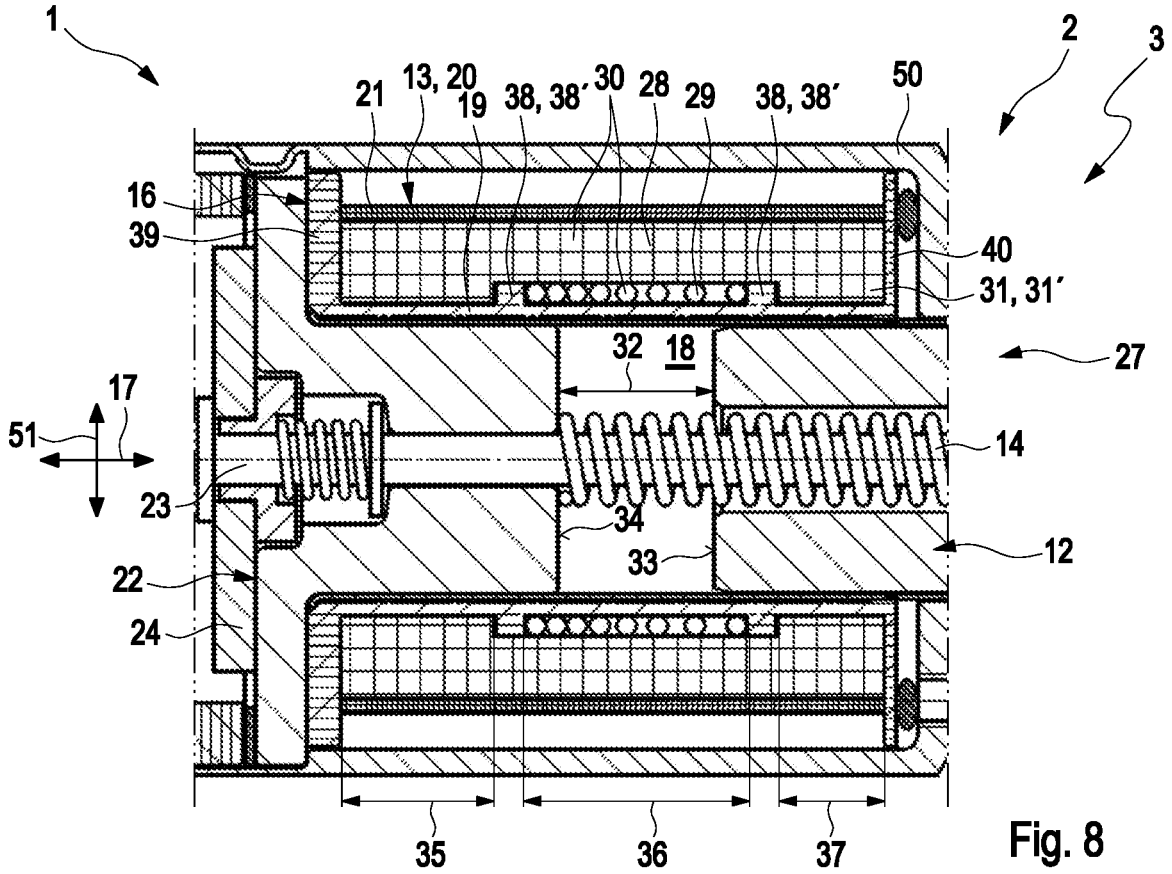
Figure 9:
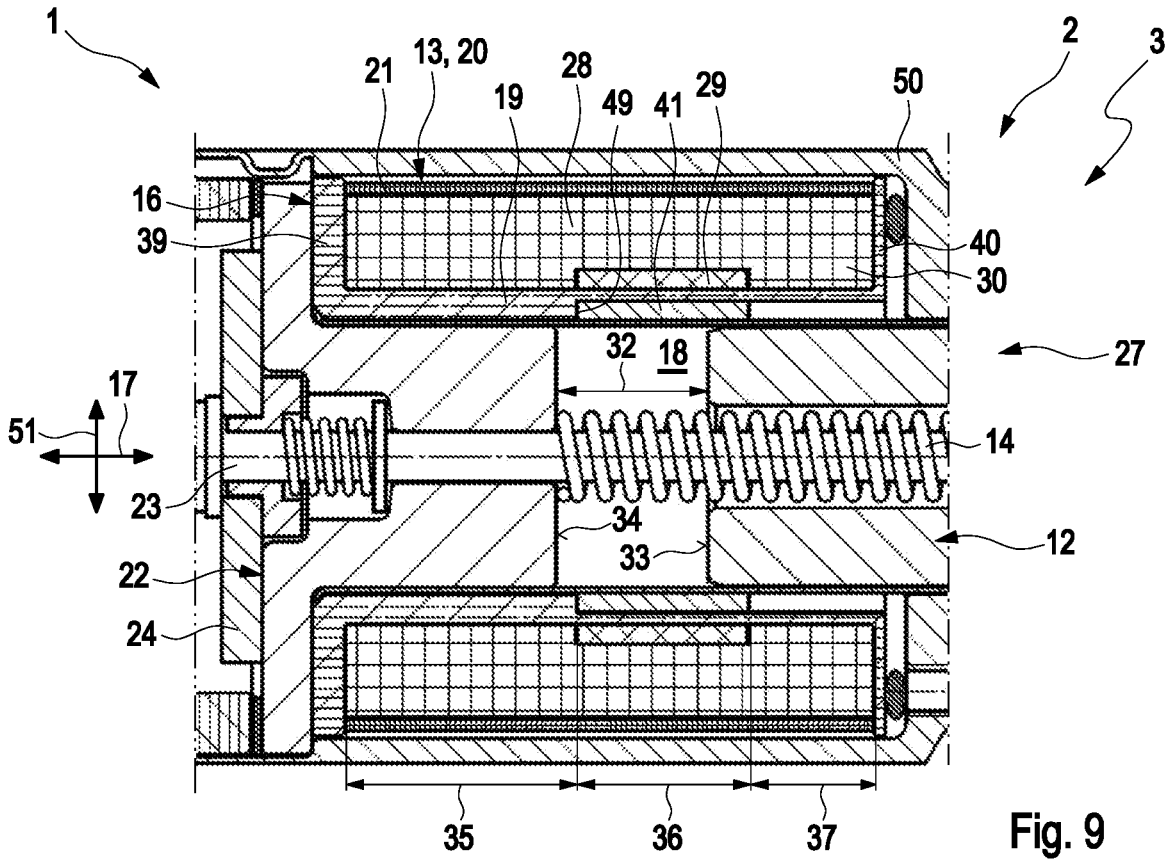
Figure 19:
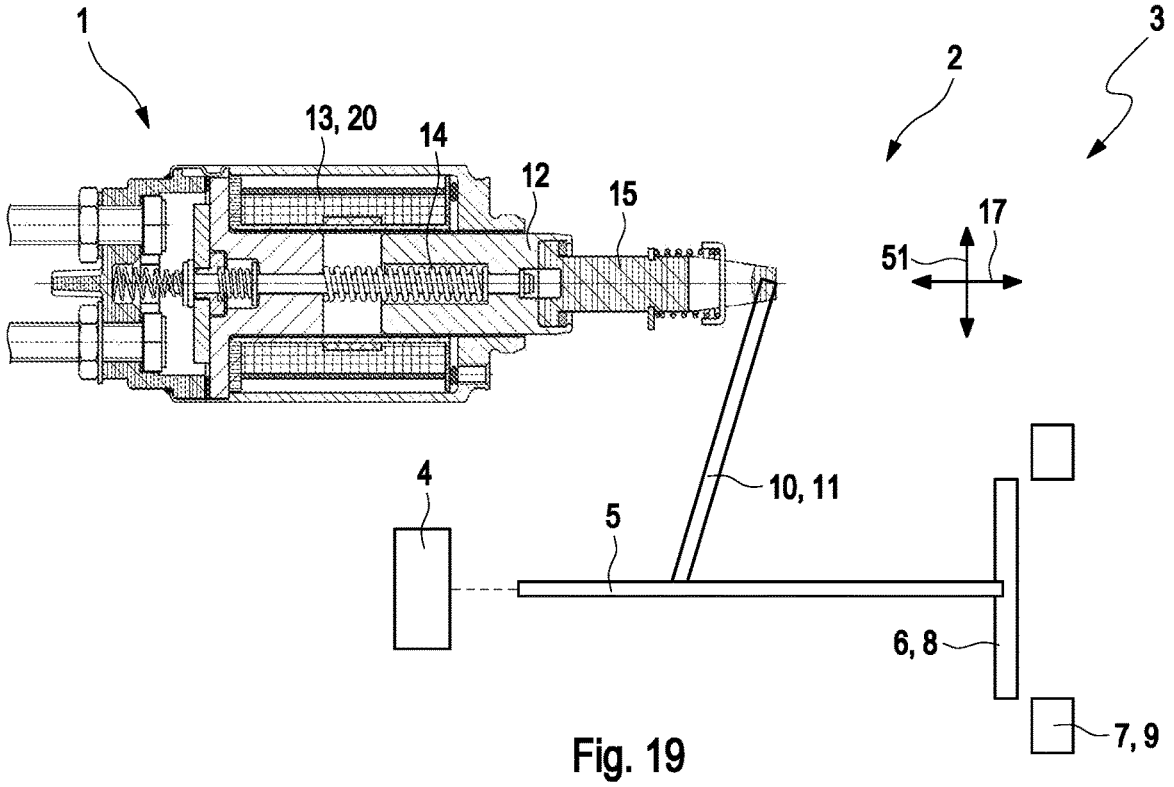
FIG. 19 shows a longitudinal section through a starting device of an internal combustion engine.

An electromagnetic switch 1, hereinafter also referred to for short as switch 1, as shown for example in FIGS. 1 to 9, is commonly a constituent part of a starting device 2 of an internal combustion engine 3, as shown by way of example in FIG. 9. The starting device 2 furthermore has an electrically operated motor 4 or electric motor 4 which, during operation, transmits a torque to a starting element 6 of the starting device 2, for example via a shaft 5, wherein the starting element 6 transmits said torque for starting the internal combustion engine 3 to a counterpart starting element 7 (see FIG. 19). For the transmission of the torque, the starting element 6, which is formed for example as a pinion 8, and the counterpart starting element 7, which is formed for example as a ring gear 9, are placed in engagement. When the internal combustion engine 3 has been started, the engagement of the starting element 6 with the counterpart starting element 7 is released. For this purpose, the starting element 6 is adjustable relative to the counterpart starting element 8. This adjustment is realized by means of the electromagnetic switch 1, which adjusts the starting element 6 via a coupling element 10, for example a lever 11. The coupling element 10 is connected in terms of drive to a piston 12 of the starting device 2 and is mounted such that an adjustment of the piston 12 in one axial direction 17 axially adjusts the starting element 6 in the opposite direction. For this purpose, the piston 12 is adjustable in the starting device 2 in the axial direction 17, and is thus axially adjustable, wherein the adjustment of the piston 12 in the axial direction 17 for the displacement of the starting element 6 in the direction of the counterpart starting element 7 is realized by means of a coil winding 13, and the adjustment of the starting element 6 away from the counterpart starting element 7 is realized by means of at least one spring 14 which acts on the piston 12. In the example shown, the piston 12 is in this case connected by means of a bolt 15, which is attached to the piston 12, to the coupling element 10.

The switch 1 has a coil carrier 16 which has a carrier wall 19, which carrier wall extends in cylindrical form in an axial direction 17 and encloses a cavity 18, and on which carrier wall the coil winding 13 is wound. In the example shown, the coil winding 13 extends from a radially projecting first end wall 39 to a radially projecting second end wall 40, which is situated axially opposite the first end wall 39, of the coil carrier 16. The end walls run in each case in closed form in a circumferential direction and are of disk-like form. Here, the coil winding 13 forms an attracting coil 20 of the switch 1. In the examples shown, the switch 1 furthermore has a holding coil 21, which is wound radially outside the coil winding 13. The coil winding 13 and the holding coil 21 are arranged in a housing 50 of the switch 1. When electrically energized, the coil winding 13 or the attracting coil 20 serves for the adjustment of the piston 12 in the direction of a core 22, which, like the piston 12, is accommodated in the cavity 18 but is fixed therein and is thus axially non-adjustable. For this purpose, during operation, that is to say when energized, the coil winding 13 and thus the attracting coil 20 and the holding coil 21 generate, within the cavity 18, a magnetic field which exerts an adjusting force on the piston 12 and thus adjusts said piston axially in the direction of the core 22. For this purpose, the piston 12 is at least partially, preferably entirely, ferromagnetic. With the holding coil 21, it is possible to hold the piston 12 in its respectively present position. The attracting coil 20 and the holding coil 21 in this case generate such a magnetic field, which subjects the piston 2 to an adjusting force opposed to the spring force of the at least one spring 14, that, for the adjustment of the piston 12 in the direction of the core 22, the spring force is overcome, and for the holding of the piston 12 in its present position, a compensation of the spring force is realized. The piston 12 is mechanically connected, by means of a connecting element 23 which is of rod-like form in the example shown, to a switching element 24. During the adjustment of the piston 12 in the direction of the core 12, which is likewise at least partially ferromagnetic, the switching element 24 is adjusted in the direction of electrical contacts 25, wherein the switching element 24, when it makes contact with the electrical contacts 25, electrically connects said contacts 25 to one another. Thus, an electrical connection is produced between two lines 26 by means of which electricity is supplied to the electric motor 4. Here, for the starting of the internal combustion engine 3, the coils 20, 21 are electrically energized, and here, adjust the piston 12 in the direction of the core 22 until the switching element 24 produces an electrical connection between the electrical contacts 25. In this state, the electrical energization of the attracting coil 13 is stopped, and the holding coil 21 is electrically energized, in order to hold the piston 12 in position and thus maintain an electrical connection between the lines 26 that supply electricity to the electric motor 4. In this position, it is furthermore the case that the starting element 6 and the counterpart starting element 7 are in engagement, such that the electric motor 4 starts the internal combustion engine 3. When the internal combustion engine 3 has been started, the supply of electricity to the starting device 1 is stopped, such that no magnetic field is generated, and the spring force adjusts the piston 12 back into a passive position 27, which is illustrated in FIGS. 1 to 19. The passive position 27 of the piston 12 is thus the position in the absence of electrical energization of the electromagnetic switch 1. The starting device 2 is in this case connected such that the electrical current that flows through the switch 1 corresponds to the current by means of which the electric motor 4 is driven. The magnetic field which is generated by the attracting coil 20, and thus the adjusting force that acts on the piston 12, and also the torque that is transmitted by means of the electric motor 4 to the starting element 6, are thus dependent on said electrical current. Here, there is a demand firstly to keep the torque of the electric motor 4 sufficiently high, or to increase said torque, such that the internal combustion engine 3 can be started in simplified fashion. Secondly, it is sought to reduce the adjusting force with which the piston 12 is adjusted in the direction of the core 22, in order to reduce damage to the starting element 6 and/or to the counterpart starting element 7, such as can arise during the production of the engagement of the starting element 6 with the counterpart starting element 7.

To reduce the adjusting force, the coil winding 13 which forms the attracting coil 20 is wound at least partially oppositely to the winding direction 28 with which the coil winding 13, when electrically energized, adjusts the piston 12 in the direction of the core 22, hereinafter referred to as first winding direction 28, specifically is wound at least partially in a second winding direction 29. A coil wire 30 of the coil winding 13 is thus wound partially in the first winding direction 28 and partially in the second winding direction 29, wherein the different winding directions 28, 29 are illustrated or indicated in FIGS. 1 and 2 and 6 to 9 by means of different hatchings of the coil winding 13.

In the examples shown, the coil wire 30 of the coil winding 13 is wound in multiple radially successive rows 31. Here, the row 31' situated closest to the cavity 18 is referred to as first row 31'.

In the passive position 27, the piston 12 is separated from the core 22 by an axial gap 32 running in an axial direction 17, which axial gap extends axially between a face side 33, facing toward the core 22, of the piston 12, hereinafter also referred to as piston face side 33, and a face side 34, facing toward the piston 12, of the core 22, hereinafter also referred to as core face side 34. Here, according to the invention, at least one of the windings wound in the second winding direction 29 is arranged so as to axially overlap the axial gap 32. Here, the coil wire 30 is, in a first axial winding section 35, wound in the first winding direction 28 around the carrier wall 19 and, in a second axial winding section 36, is wound in the second winding direction 29 around the carrier wall 19.

Here, the first winding section 35 is to be understood to mean that section of the coil winding 13 which is wound in the first winding direction 28 and thus extends axially. The second winding section 36 is that section of the coil winding 13 in which the coil wire 30 is wound in the second winding direction 29. Accordingly, the second winding section 36 extends axially. It is also possible for the second winding section to extend across multiple radially successive rows 31 of the coil winding 13.

In the examples shown in FIGS. 1 to 5 and 8 and 9 and also 11 and 12, the coil wire 30 is furthermore, in a third axial winding section 37, likewise wound in the first winding direction 28 around the carrier wall 19, wherein the second winding section 36 is arranged axially between the first winding section 35 and the third winding section 37. The third winding section 37 thus corresponds to the first winding section 35, with the difference that, in the row 31 in which the second winding section 36 is arranged, the first winding section 35 and the third winding section 37 are arranged on axially mutually averted sides of the second winding section 36.

Figure 3:
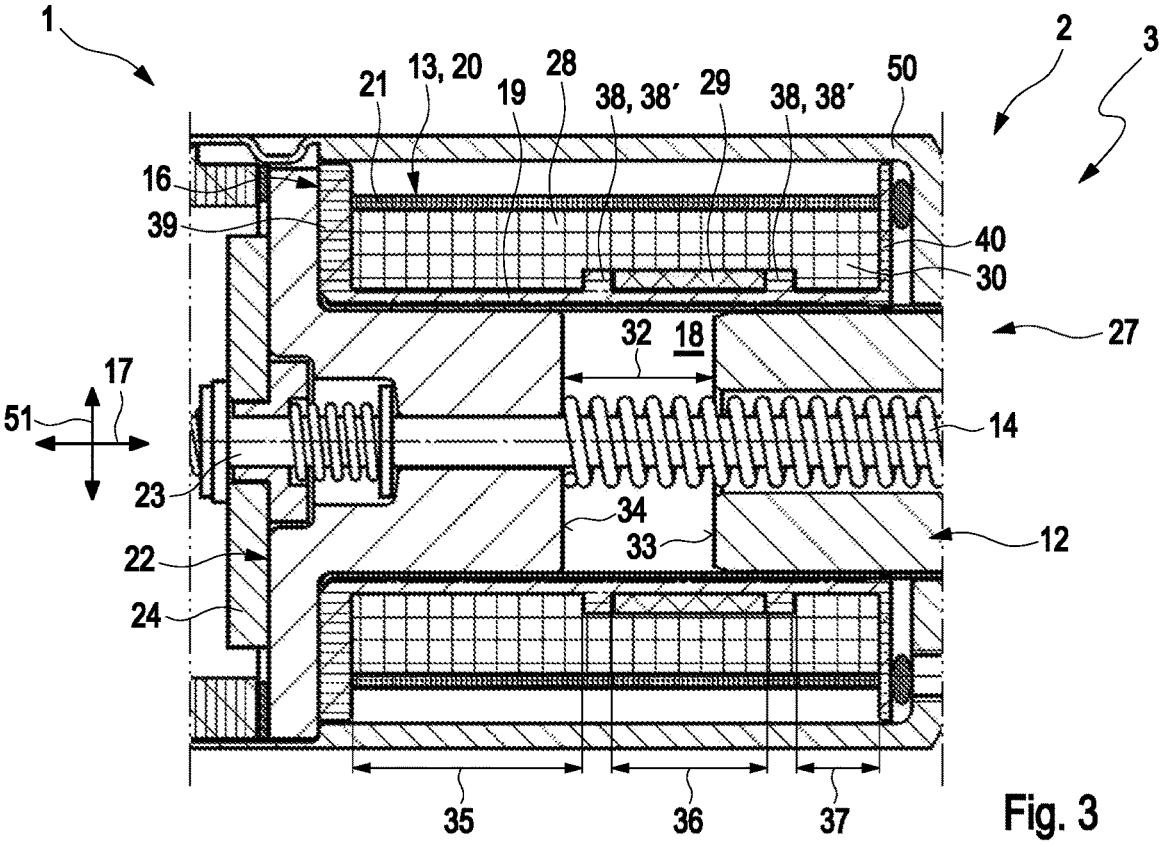
FIGS. 3 through 18 each show a longitudinal section through the electromagnetic switch, in each case in a different exemplary embodiment.
Figure 4:
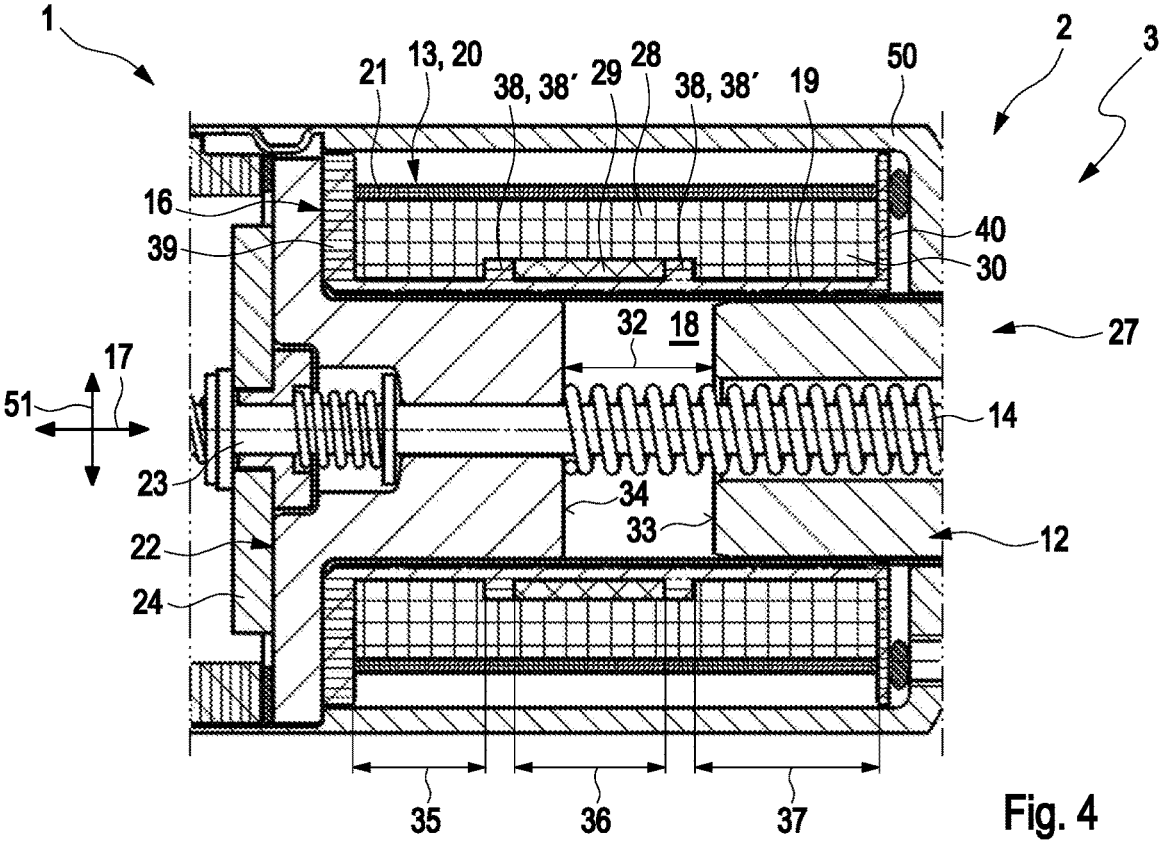
Figure 5:
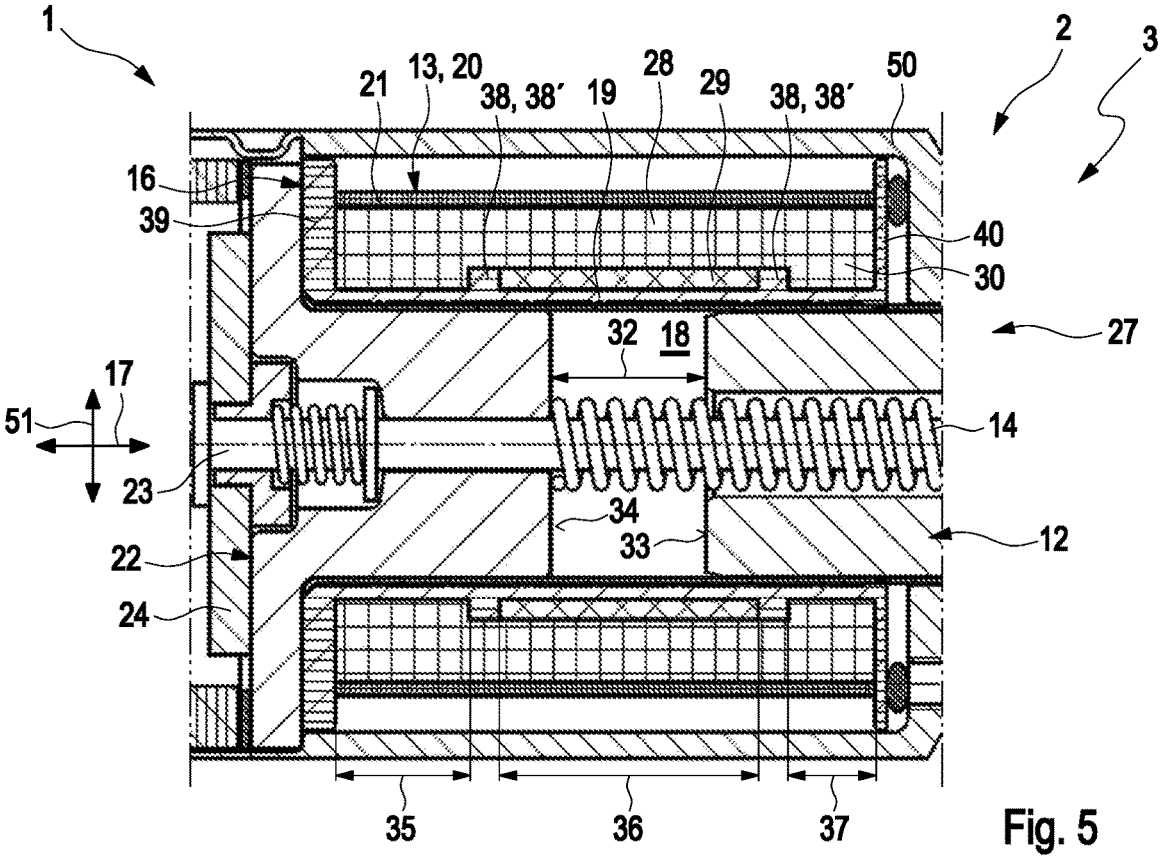

The transition between the first winding direction 28 and the second winding direction 29 is, in the examples of FIGS. 3 to 5 and also 7, 8 and 12, separated by means of a separating body 38 of the coil carrier 16, which separating body projects radially from the carrier wall 19 and extends in a circumferential direction. The separating bodies 38 are arranged axially between the end walls 39, 40 and are arranged so as to be axially spaced apart from one another.

Figure 1:
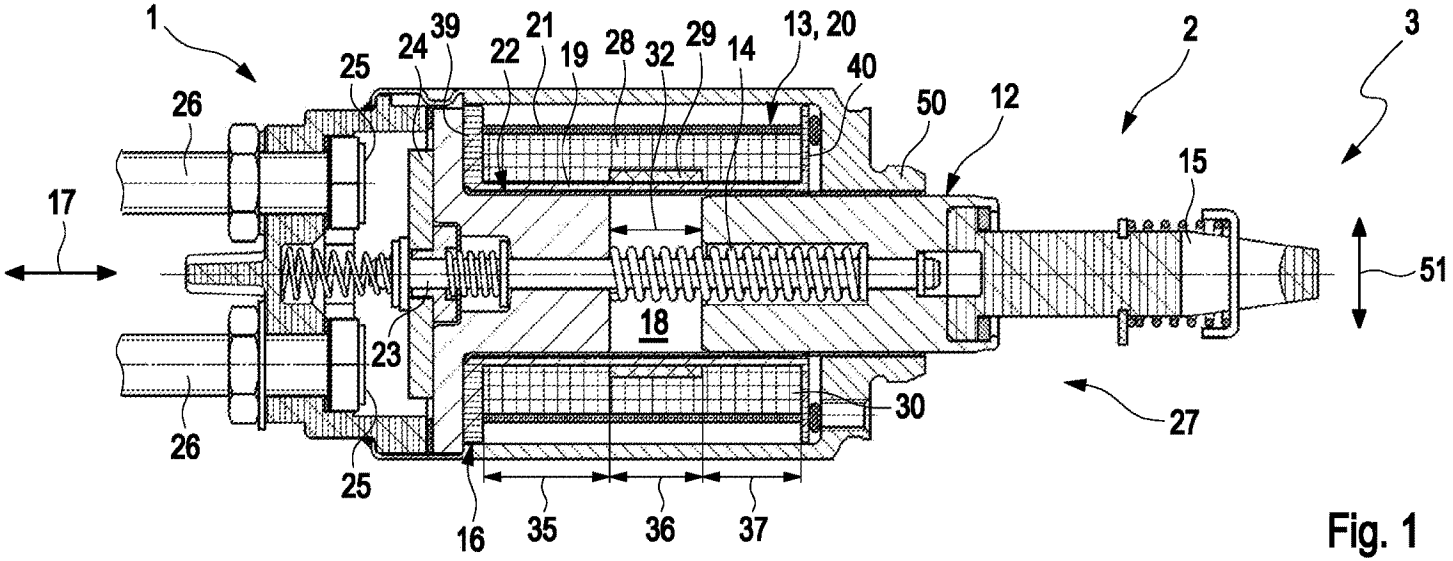
FIG. 1 shows a longitudinal section through an electromagnetic switch.
Figure 2:
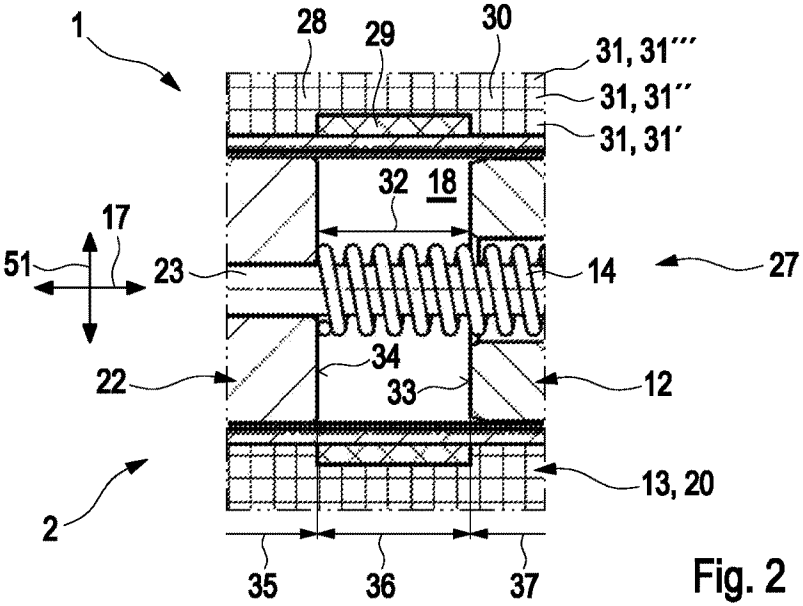
FIG. 2 is an enlarged illustration from FIG. 1.

In the example shown in FIGS. 1 and 2, the second winding section 36 corresponds, in its length running in the axial direction 17, substantially to the axially running length of the axial gap 32, wherein, in the passive position 27, the second winding section 36 and the axial gap 32 are arranged substantially in alignment. Here, all of the windings of the second winding section 36 are arranged so as to axially overlap the axial gap 32.

The example shown in FIG. 3 differs from the example shown in FIG. 2 in particular in that the windings wound in the second winding direction 29, and thus the second winding section 36, have been relocated axially toward the piston 12, such that the second winding section 36 partially axially overlaps the axial gap 32 and partially axially overlaps the piston 12.

FIG. 4 shows an example in which, in relation to that in FIGS. 1 and 2 and by contrast to the example shown in FIG. 3, the second winding section 36 has been relocated axially toward the core 22, such that the windings, wound in the second winding direction 29, of the second winding section 36 partially axially overlap the axial gap 32 and partially axially overlap the core 22.

The exemplary embodiment shown in FIG. 5 differs from the exemplary embodiment shown in FIGS. 1 and 2 in that the axial length of the second winding section 36, in which the coil wire 30 is wound in the second winding direction 29, is greater than the axial extent of the axial gap 32. Furthermore, the second winding section 36 is arranged so as to extend over the entire axial gap 32, and furthermore so as to partially axially overlap the piston 12 and partially axially overlap the core 22.

In the examples shown in FIGS. 3 to 5, the transition between the first winding direction 28 and the second winding direction 29 is separated in each case by a separating body 38 of the coil carrier 16, which separating body projects radially from the carrier wall 19 and extends in the circumferential direction and is discontinuous. In these examples, the coil body 16 therefore has two such separating bodies 38, which are axially spaced apart from one another, wherein one of the separating bodies 38 separates the second winding section 36 axially from the first winding section 35 and the other separating body 38 separates the second winding section 36 axially from the third winding section 37. The separating bodies 38 are arranged axially between the end walls 39, 40 and are arranged so as to be axially spaced apart from one another.

Figure 6:
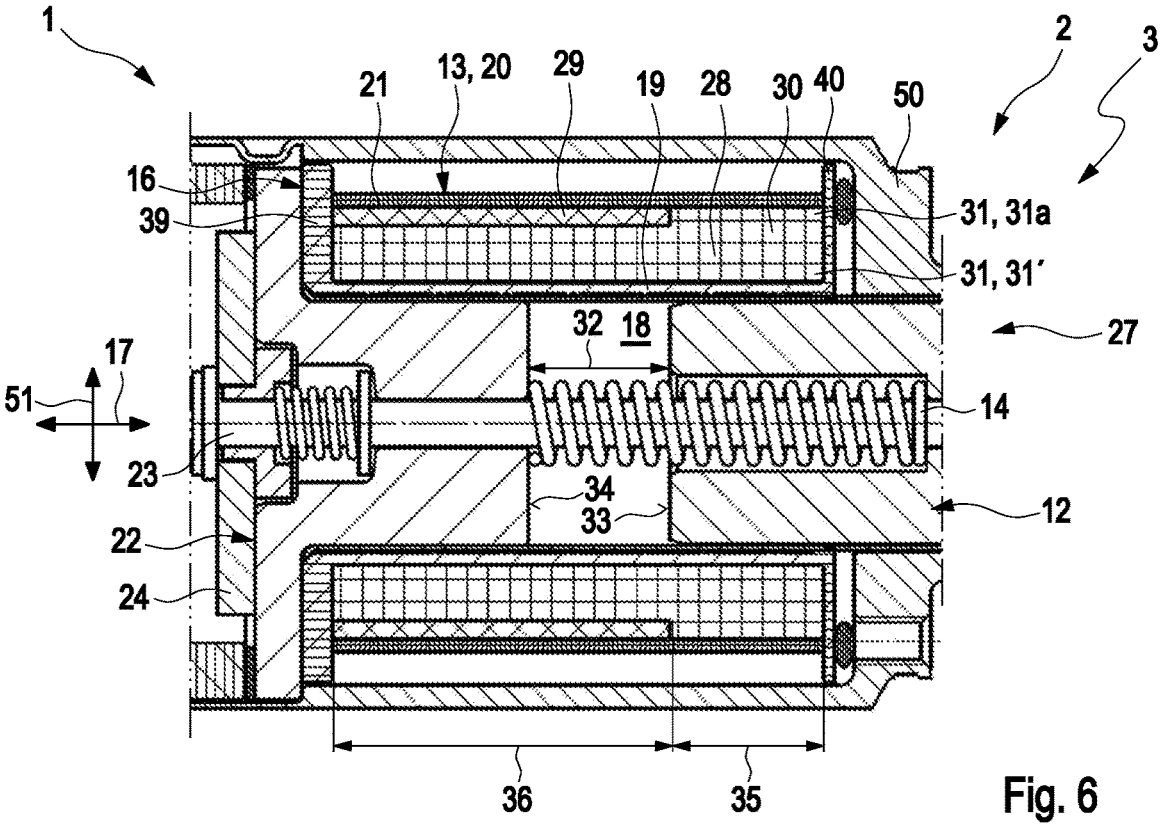

FIG. 6 shows an exemplary embodiment in which the coil wire 30 of the coil winding 13 is arranged not in the row 31 situated radially closest to the cavity 18 or to the radial gap 32 but in the row 31 situated radially furthest remote from the axial gap 32 or the cavity 18, hereinafter also referred to as last row 31*a*. In comparison with the example shown in FIGS. 1 and 2, the second winding section 36 has been relocated toward the core 22, and extends axially from the first end wall 39 to the second piston face side 33. The second winding section 36 thus axially entirely overlaps the core 22 and the axial gap 32. In this example, it is furthermore the case that no third winding section 37 is provided.

The exemplary embodiment shown in FIG. 7 differs from the example shown in FIG. 6 in that the second winding section 36 with the coil wire 30 wound in the second winding direction 29 is arranged in the first row 31' of the coil winding 13, and thus in the row 31 situated radially closest to the cavity 18 and to the axial gap 32. In this exemplary embodiment, it is furthermore the case that the coil carrier 16 is equipped with a separating body 38 which separates the second winding section 36 axially from the first winding section 35, wherein the first winding section 35 extends in the first row 31' from the separating body 38 to the second end wall 40.

FIG. 8 shows a further exemplary embodiment. This exemplary embodiment differs from the exemplary embodiment shown in FIG. 5 in that a pitch of the coil wire 30 in the second winding section 36 wound in the second winding direction 29 varies axially. This means that a spacing of successive windings of the second winding section 36 changes in the axial direction 17, wherein, to illustrate the varying pitch of the coil wire 30, the coil wire 30 is shown in section, rather than by hatching as in FIGS. 1 to 7 and also 9 to 19. In the example shown, the pitch decreases toward the core 22, such that the coil wire 30 is wound more densely, that is to say with an axially decreasing spacing, toward the core 22.

FIG. 9 shows a further exemplary embodiment of the switch 1. This exemplary embodiment differs from the example shown in FIG. 3 in that the switch 1 additionally has a ferromagnetic bypass body 41, which encloses the cavity 18, in the example shown the axial gap 32, and is arranged radially between the cavity 18, in the example shown the axial gap 32, and the coil winding 13. Here, the bypass body is arranged so as to axially overlap the axial gap 32, and at least one winding of the second winding section 36 is arranged so as to axially overlap the bypass body 41. The bypass body 41 diverts the magnetic field or the magnetic flux in the cavity 18 between the piston 12 and the core 22, wherein the bypass body 41 has a saturation limit. The at least one winding, which axially overlaps the bypass body 41, of the second winding section 36 reduces the magnetic flux through the bypass body 41, such that, ultimately, an increased magnetic flux can flow through the bypass body 41, until the latter reaches the saturation limit. This directly leads to a reduction of the magnetic field or of the magnetic flux between the piston 12 and the core 22, such that the adjusting force is correspondingly reduced.

In the example of FIG. 9, the second winding section 36 and the bypass body 41 have a substantially equal extent in the axial direction 17, and are arranged in alignment in a radial direction 51 running transversely to the axial direction 17. In the example shown in FIG. 9, by comparison with the example shown in FIG. 3, the coil body 16 furthermore has no separating body 38, wherein a separating body 38 of said type is also conceivable.

Figure 10:
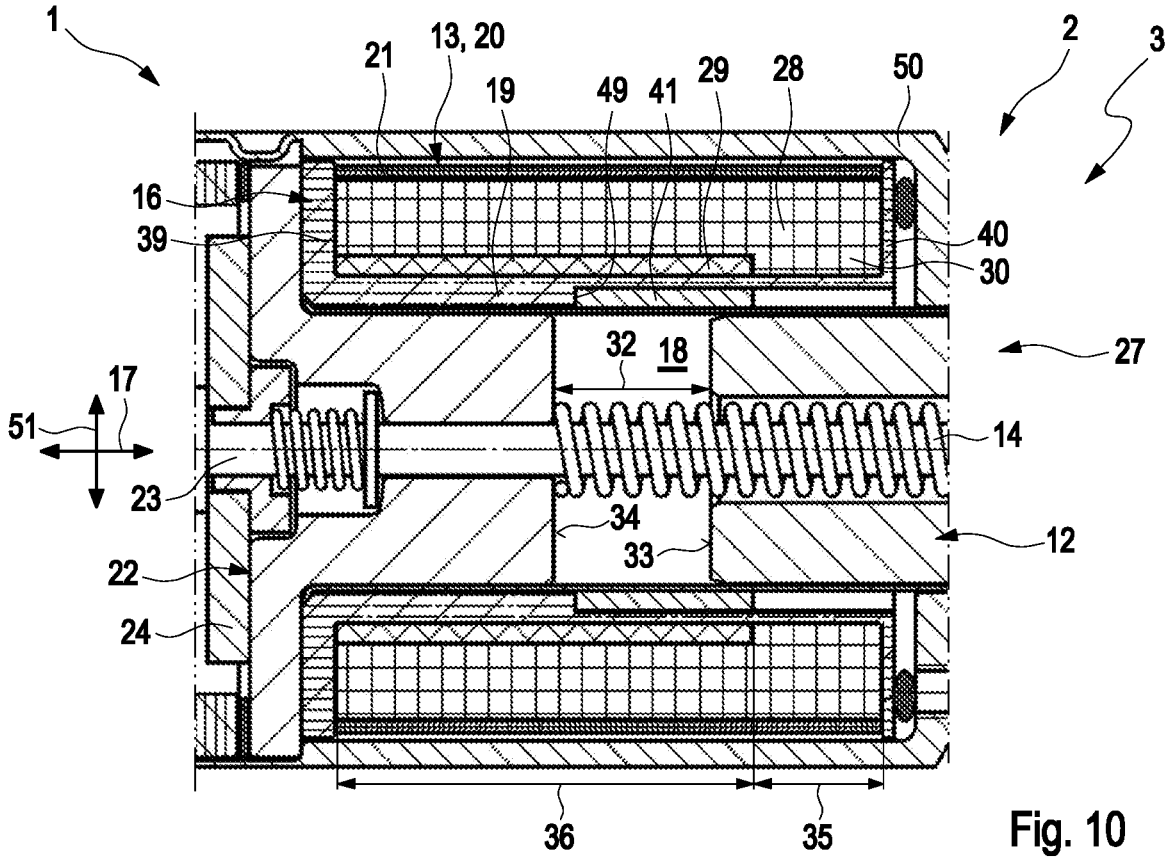

The exemplary embodiment shown in FIG. 10 differs from the example shown in FIG. 9 in that the second winding section 36 has been extended toward the first end wall 39, such that the second winding section 36 extends as far as the first end wall 39. Thus, in this example, the coil winding 13 has the second winding section 36 and the first winding section 35. The second winding section 36 thus also axially overlaps the core 22.

Figure 11:
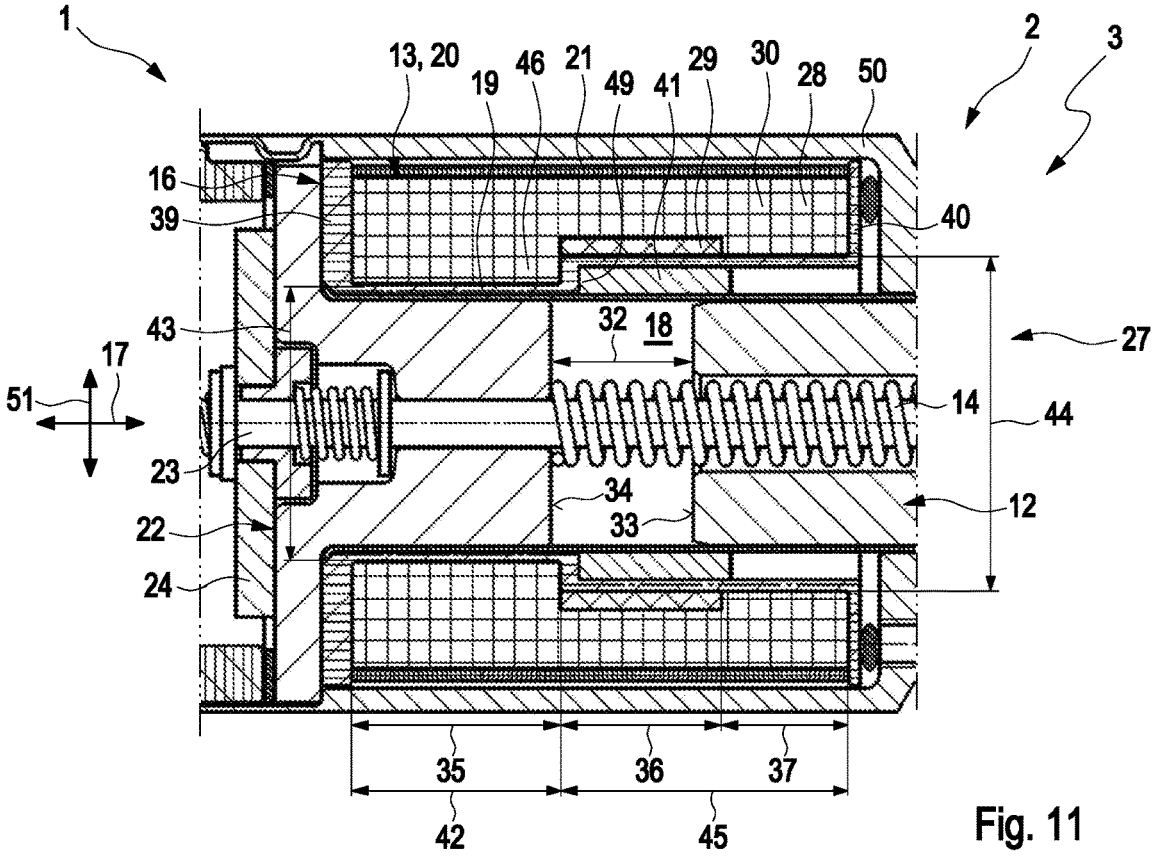

FIG. 11 shows a further exemplary embodiment of the switch 1. This exemplary embodiment differs from the exemplary embodiment shown in FIG. 9 in that the bypass body 41 is dimensioned to be radially larger, and is thus thicker. Furthermore, by comparison with the example shown in FIG. 9, the second winding section 36 has been relocated toward the core 22. Both the bypass body 41 and the second winding section 36 are in each case arranged so as to axially overlap one another and the axial gap 32. The carrier wall 19 is equipped with a radial step, such that said carrier wall, in an axially running first wall section 42, has an outer diameter 43, hereinafter referred to as first outer diameter 43, which is smaller than an outer diameter 44 in an axially adjoining second wall section 45, hereinafter referred to as second outer diameter 44. Therefore, the carrier wall 19 has, in the first wall section 42, a chamber 46 which is recessed toward the cavity 18. In the example shown, the chamber 46 is filled with coil wire 30 wound in the first winding direction 18. Axially adjacent to the chamber 46, the coil wire 30 is wound in the second winding direction 29, such that the second winding section 36 is wound on the second wall section 45. That side of the second winding section 36 which is axially averted from the chamber 6 is adjoined by the third winding section 37. In this exemplary embodiment, too, the second winding section 36 is, in the region in which it is arranged, arranged radially as close as possible to the axial gap 32. This means that that side of the second winding section 36 which faces radially toward the cavity 18 or the axial gap 32 is free from the coil wire 30.

Figure 12:
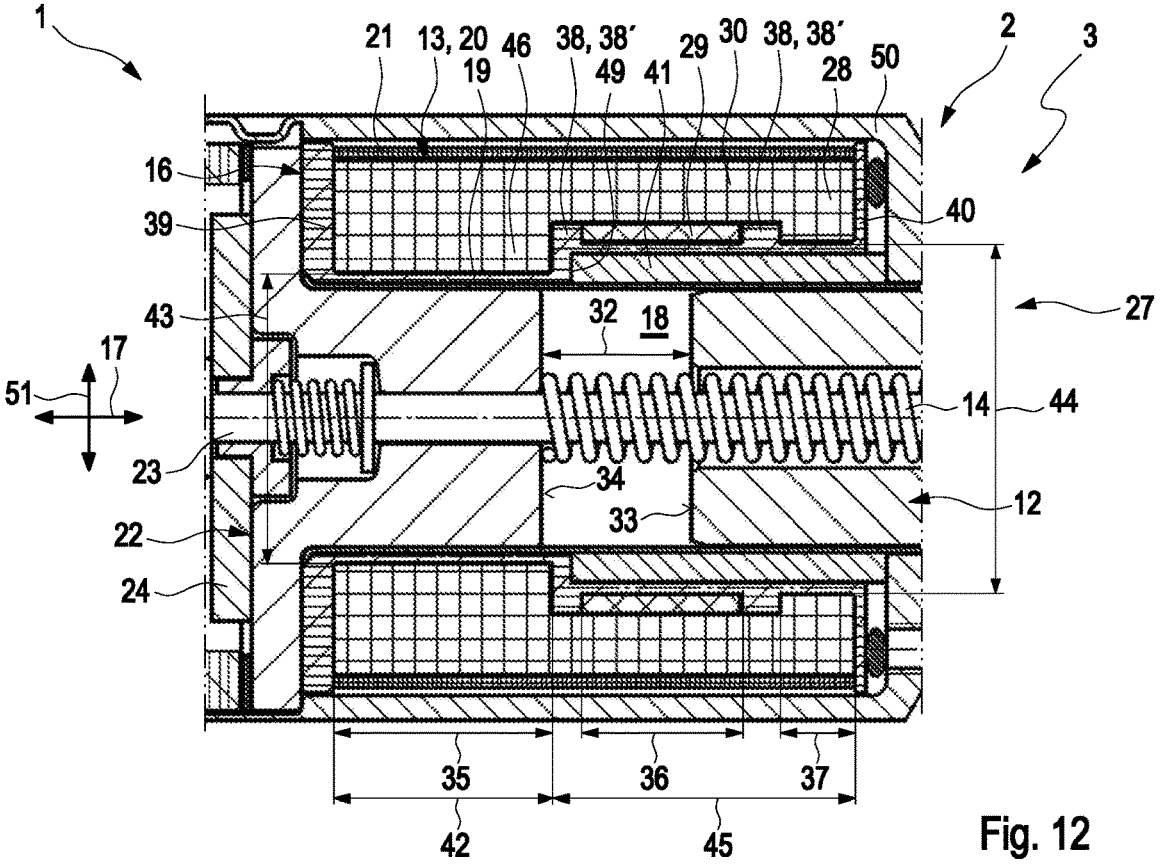

A further exemplary embodiment of the switch 1 is illustrated in FIG. 12. This exemplary embodiment differs from the example shown in FIG. 11 in that the bypass body 41 extends toward the piston 12 and, here, is formed so as to be larger in the axial direction 17 than the second winding section 36. Furthermore, the coil carrier 16 is equipped with two separating bodies 38, which separate the second winding section 36 in each case from the third winding section 37 or from the first winding section 35.

In the examples shown, it is furthermore the case that the bypass body 41 is always axially spaced apart from the core 22.

In the examples shown in FIGS. 9 to 12, the bypass body 41 is accommodated by means of the coil carrier 16. For this purpose, the coil body 16 has an axial shoulder 49 which extends in a circumferential direction. Here, the bypass body 41 is surrounded in form-fitting fashion by the carrier wall 19 or the shoulder 49. In the example shown in FIGS. 11 and 12, the chamber 46, or the difference between the outer diameters 43, 44, is also realized by means of said shoulder 49.

In the example of FIG. 12, the bypass body 41 is, on the side averted from the shoulder 49, furthermore surrounded axially in form-fitting fashion by the housing 50. In other words, on the side averted from the shoulder 49, the bypass body 41 abuts axially against the housing 50. By contrast, in the other examples, the bypass body 41 is axially spaced apart from the housing 50.

FIGS. 13 to 18 show examples in which the coil wire 30 has a non-ferromagnetic section 47, composed for example of copper, aluminium and the like, and a ferromagnetic section 48, composed for example of iron, nickel and the like. In the examples shown in FIGS. 13 and 14, the second winding section 36 is formed by the ferromagnetic wire section 48, hereinafter also referred to as second wire section 48, whereas the non-ferromagnetic section 47 of the coil wire 30, hereinafter referred to as first wire section 47, is wound in the first winding direction 28. Here, the second wire section 48 is wound first, and the first wire section 47 is wound subsequently, onto the coil carrier 16.

Figure 13:
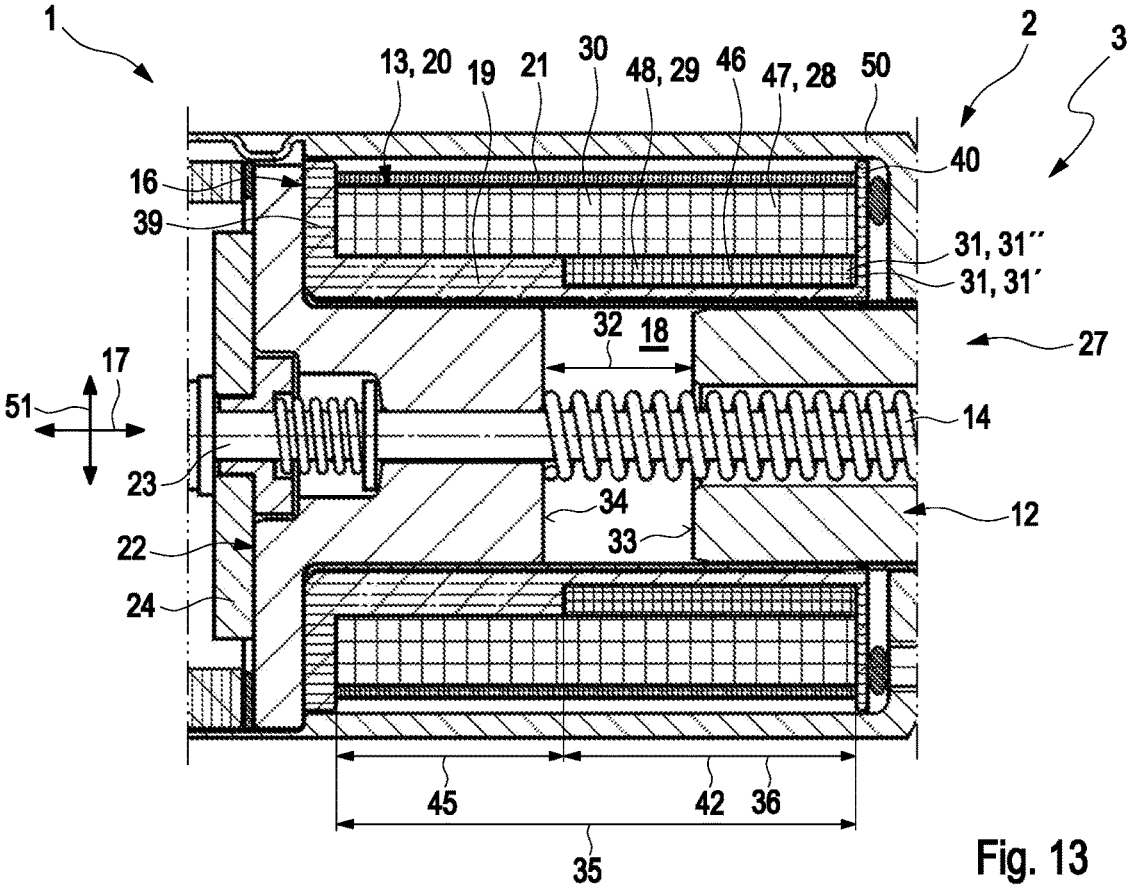
Figure 14:
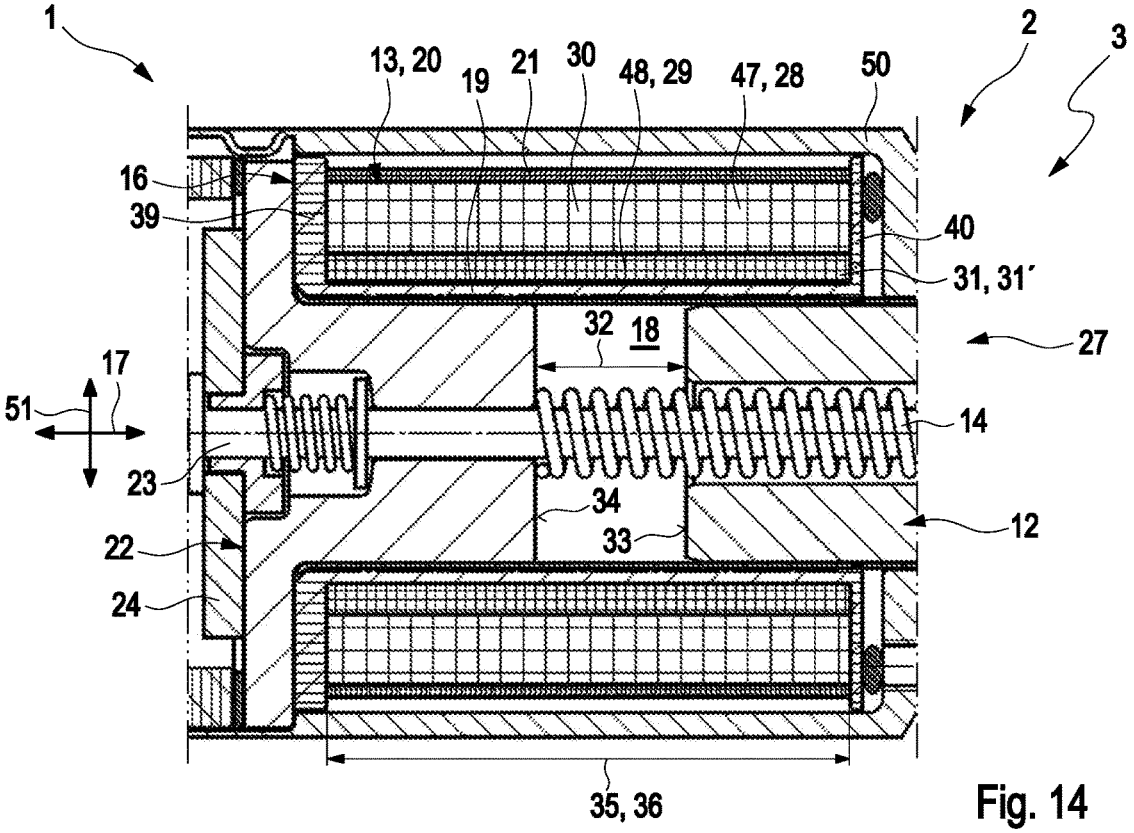

In the examples of FIGS. 13 and 14, this has the result that the first wire section 47 is wound entirely onto the second wire section 48. In other words, the first wire section, which is wound in the first winding direction 28, is wound onto the second wire section 48, which is wound in the second winding direction 29 and which forms the second winding section 36. Here, the ferromagnetic second wire section 48 is illustrated with denser hatching than the non-ferromagnetic first wire section 47 of the coil wire 30 of the coil winding 13. In FIG. 13, the second wire section 48 and thus the second winding section 36 are arranged in the chamber 46 and fill the chamber 46. In the example of FIG. 14, the second winding section 36 extends from the first end wall 39 to the second end wall 40. Furthermore, in these examples, multiple rows 31 of the second winding section 36 are provided. In FIG. 13, the second winding section 36 and thus the second wire section 48 are furthermore spaced apart axially with respect to the core 22. In FIG. 14, the first winding section 36, like the second winding section 35, extends axially between the end walls 39, 40 of the winding carrier 16.

Figure 15:
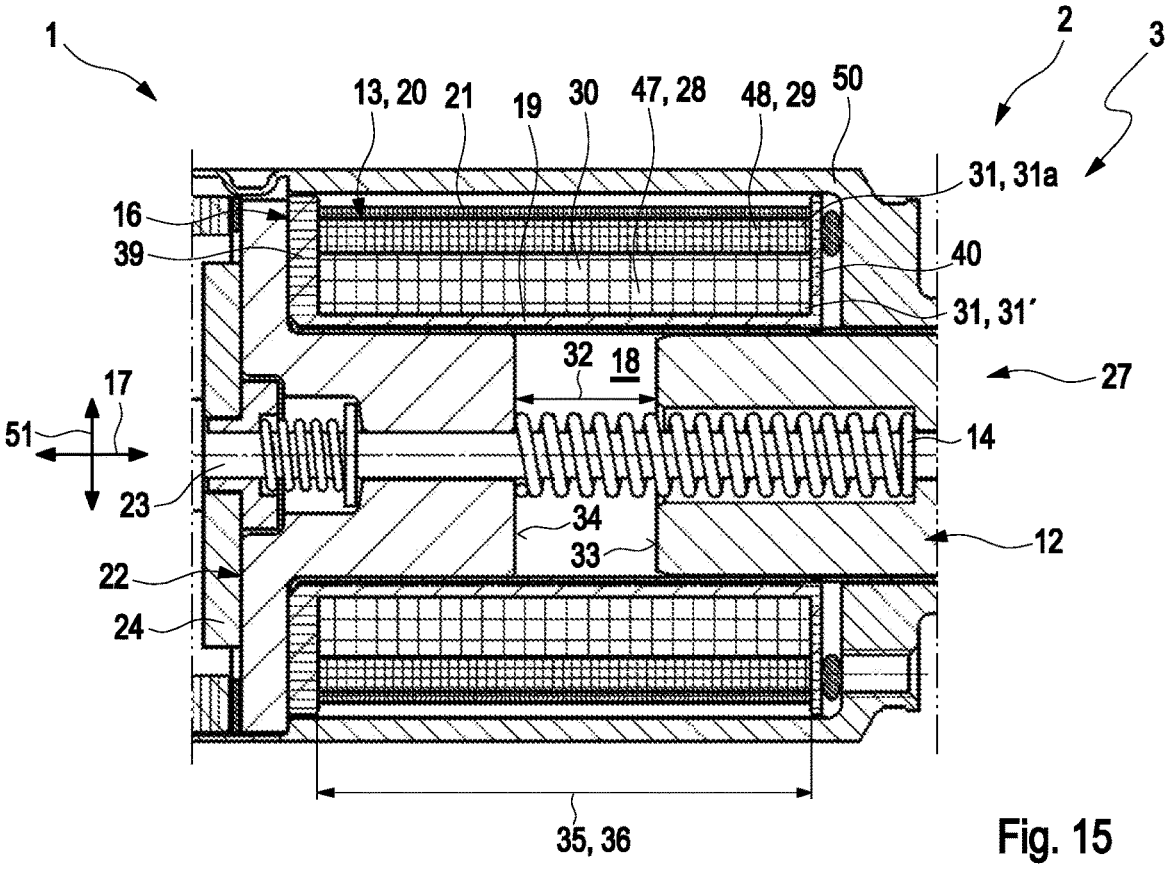

FIG. 15 shows a further exemplary embodiment of the switch 1. This exemplary embodiment differs from the examples shown in FIG. 14 in that the second winding section 36 is wound from the second wire section 48 on that side of the first wire section 47, and thus of the first winding section 35, which is radially averted from the cavity 18 or from the axial gap 32.

In the examples shown in FIGS. 13 to 15, the respective row 31 of the coil winding 13 is thus wound either with the non-ferromagnetic first wire section 47 or with the ferromagnetic second wire section 48.

Figure 16:
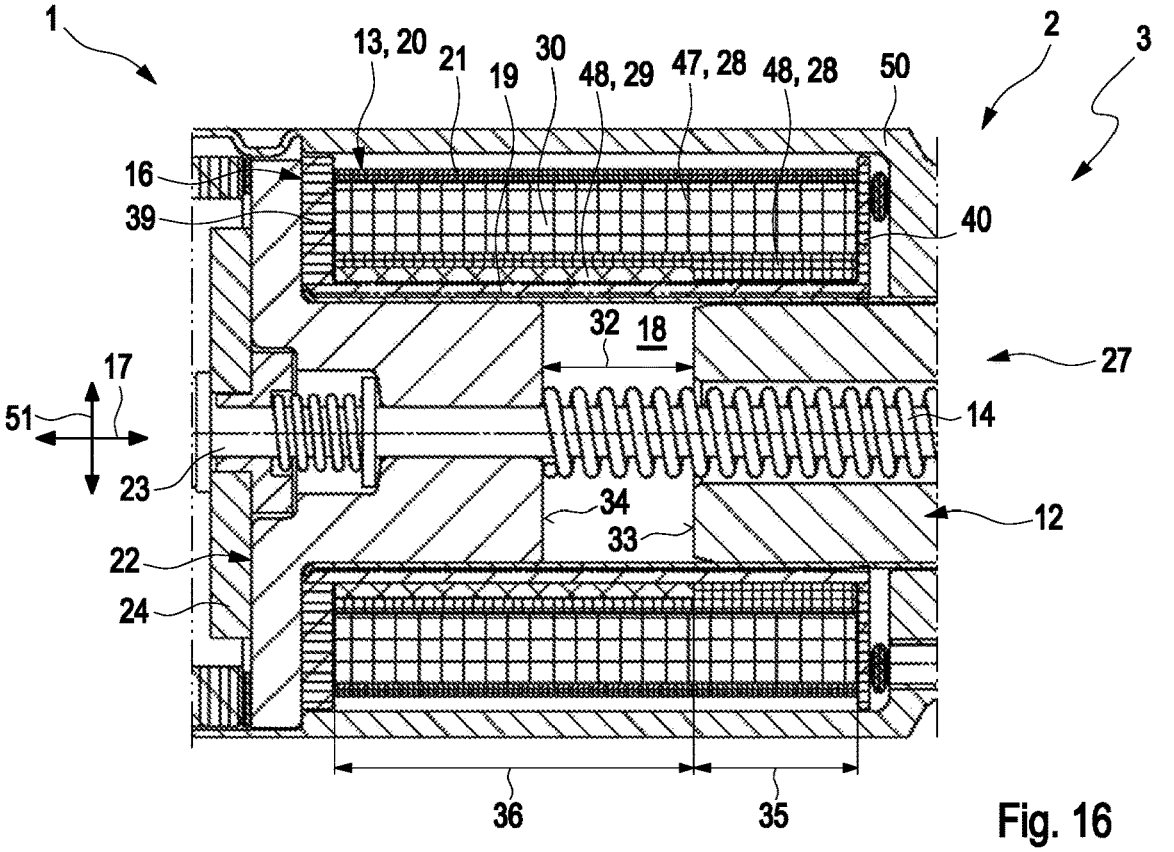
Figure 17:
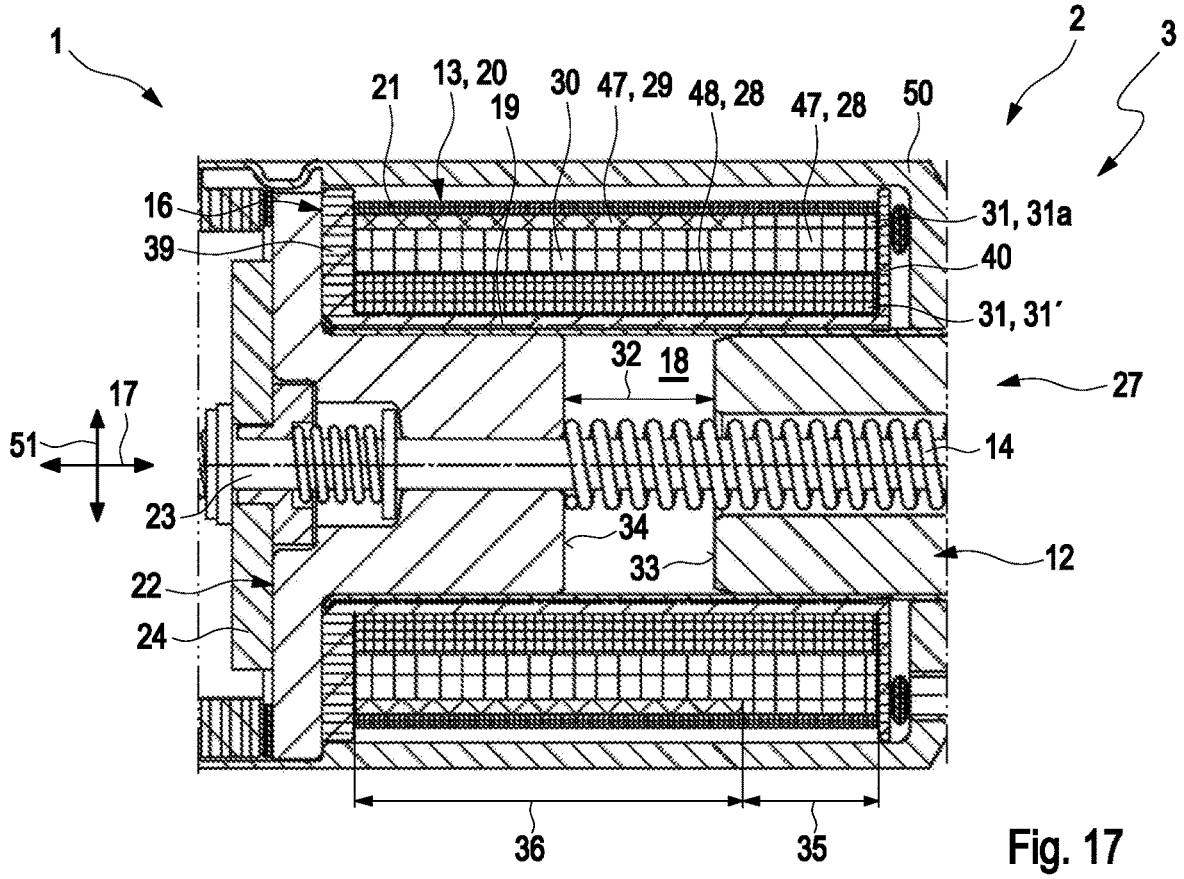
Figure 18:
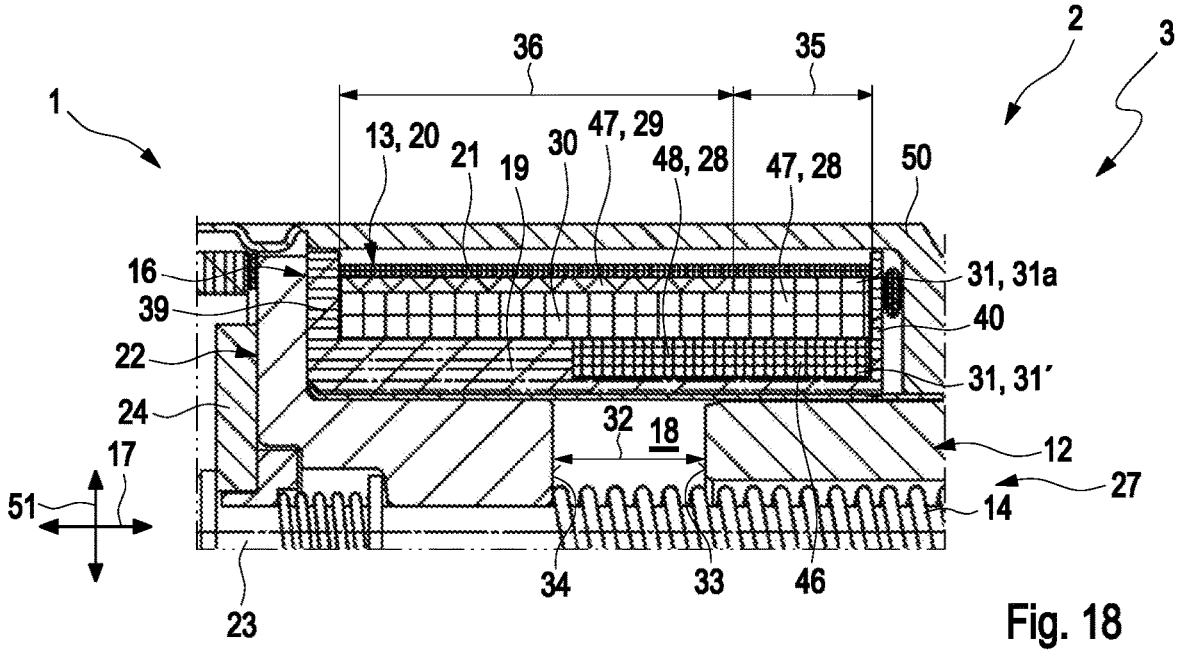

FIGS. 16 to 18 show examples in which both the first wire section 47 and the second wire section 48 are wound within one row 31 of the coil winding 13.

In the example shown in FIG. 17, firstly, multiple rows 31 are wound with the ferromagnetic second wire section 48 in the first winding direction 28, and, subsequently, multiple rows 31 of the non-ferromagnetic first wire section 47 are wound in the first winding direction 48. In the adjoining row 31, firstly, the ferromagnetic second wire section 48 is wound in the first winding direction, and subsequently, the non-ferromagnetic first wire section 47 is wound in the second winding direction 29. Here, the second winding section 36 runs from the first end wall 39 and overlaps the axial gap 32 and, in part, the piston 12.

In the exemplary embodiment shown in FIG. 16, in the first row 31', firstly, the ferromagnetic second wire section 48 is wound in the second winding direction 29, and subsequently, the non-ferromagnetic first wire section 47 is wound in the first winding direction 28. The two adjoining rows 31 are also wound with the ferromagnetic second wire section 48 in the first winding direction 28. The following rows 31 are also wound with the non-ferromagnetic first wire section 47 in the first winding direction 28. The second winding section 36 however in this case extends, as in the example of FIG. 17, axially from the first end wall 39 of the coil carrier 16 to the piston face side 33.

The exemplary embodiment shown in FIG. 18 differs from the exemplary embodiment shown in FIG. 17 in that the coil carrier 16 has a chamber 46, wherein the ferromagnetic second wire section 48 in the first winding direction 28 completely fills the chamber 46, such that, outside the chamber 46, the non-ferromagnetic first wire section 47 is wound firstly in the first winding direction 28 and subsequently in the second winding direction 29. Here, FIG. 18 illustrates only the radially upper half of the section.

In all of the examples, the coil winding 13 always has fewer windings in the second winding direction 29 than in the first winding direction 28.

Figure 20:
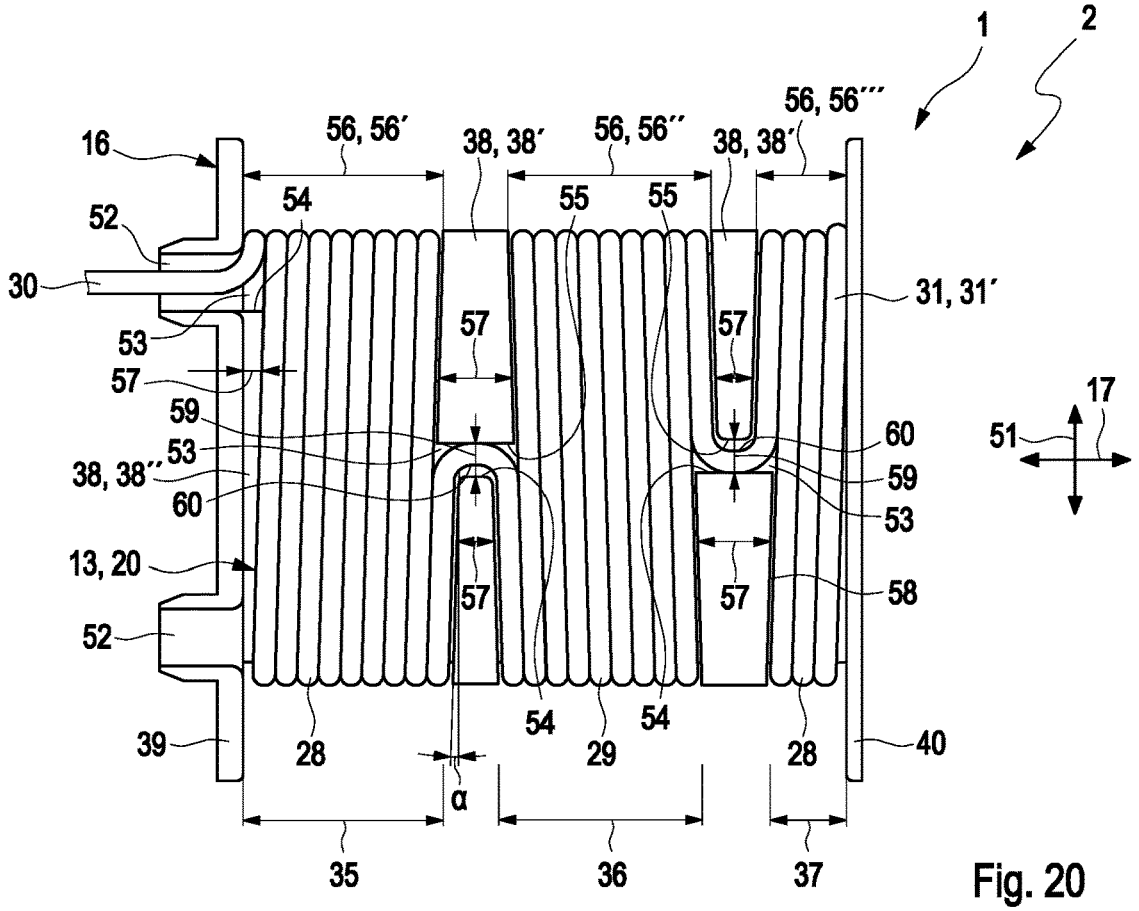
FIG. 20 shows a side view of the electromagnetic switch from FIG. 3.
Figure 21:
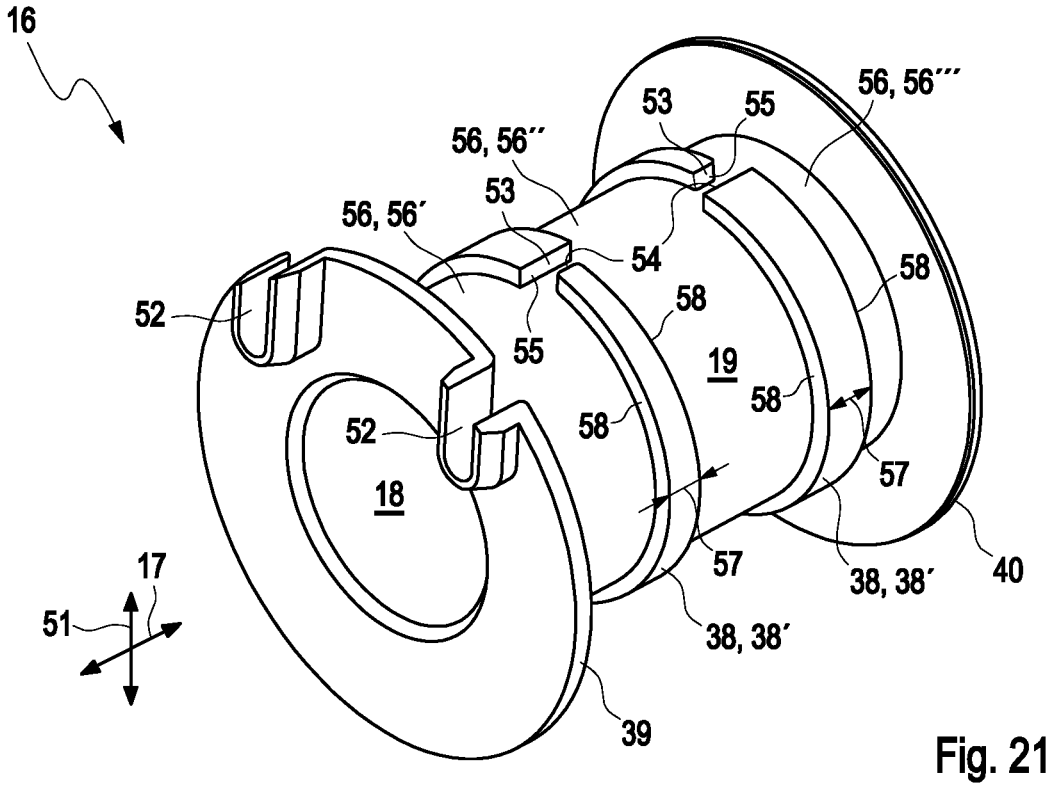
FIG. 21 shows an isometric view of the single coil carrier from FIG. 20.
Figure 22:
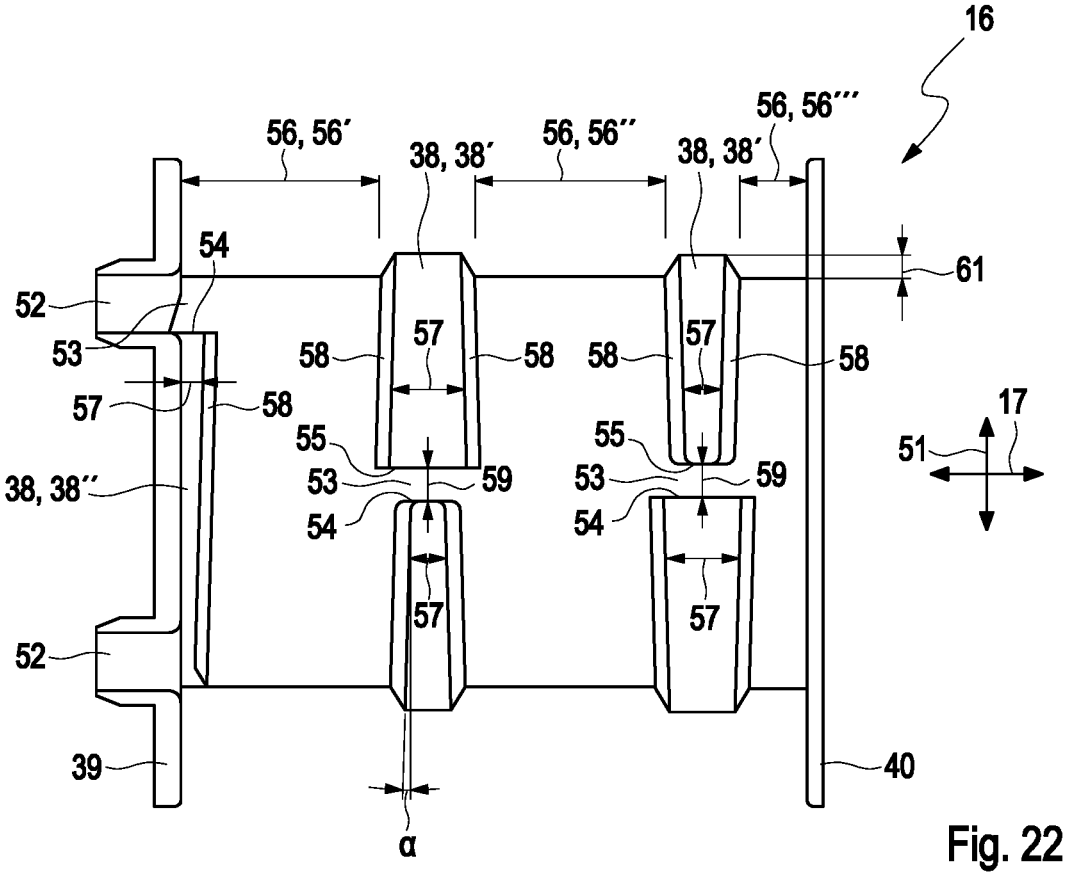
FIG. 22 shows a side view of the coil carrier in the case of a different exemplary embodiment.

The respective coil body 16 may, for example in an end wall 39, 40, in the examples shown in the first end wall 39, have two leadthroughs 52, formed as radial apertures, for the leadthrough of the coil wire 30 (see FIGS. 20 to 22).

An example of the coil body 16 with at least one separating body 38 will be discussed in more detail on the basis of FIGS. 20 to 22, which in this case involve, merely by way of example, a coil body 16 of the switch 1 from FIG. 3. It is however self-evident that the features are correspondingly transferable to the other coil bodies 16.

Here, FIG. 20 illustrates a side view of the electromagnetic switch 1 only with the coil wire 30 in the first row 31' and the coil carrier 16, and FIG. 21 illustrates an isometric view of the coil carrier 16. It can be seen that, in addition to the separating sections 38 visible in FIG. 3, which are arranged between the end walls 39, 40 and which will hereinafter also be referred to as intermediate separating bodies 38', a separating body 38 is also arranged axially on the end side of the carrier wall 19, and therefore in the example shown so as to axially adjoin the end wall 39, which will hereinafter also be referred to as end carrier wall 38". The respective separating body 38 extends in the circumferential direction and has, in the circumferential direction, a recess 53, which separates a first separating body end 54 from a second separating body end 55 of the separating body 38 in the circumferential direction. The respective intermediate separating body 38' in this case separates two wall segments 56 of the carrier wall 19 from one another in the axial direction 17, wherein the wall segments 56 that are separated in this way are connected to one another by means of the recess 53 of the separating body 38'. The recess 53 of the end separating body 38" is formed so as to transition into the leadthrough 52. Here, the coil wire 30 is introduced into the coil carrier via one of the leadthroughs 52 and via the recess 53 of the end separating body 38", wherein the winding of the coil wire 30 starts or ends in the region of the recess 53 of the end separating body 38". In the example shown, the coil carrier 16 has two intermediate separating bodies 38". A first of the separating bodies 38' in this case separates a first wall segment 56' of the carrier wall 19 axially from a second wall segment 56" of the carrier wall. Furthermore, a second of the intermediate separating bodies 38' separates the second wall segment 56" axially from a third wall segment 56'" of the carrier wall 19. The first winding section 35 is wound in the first winding direction 28 on the first wall segment 56', the second winding section 36 is wound in the second winding direction 29 on the second wall segment 56", and the third winding section 37 is wound in the first winding direction 28 on the third wall segment 56'". Here, the coil wire 30 is led through the recess 53 of the respective intermediate separating body 38', such that a reversal of the winding direction 28, 29 is realized via the recess 53. Here, an axially running body width 57 of the respective separating body 38 decreases between one of the separating body ends 54, 55 and the other separating body end 54, 55, and thus along the circumferential direction. In the example shown, the body width 57 decreases continuously from one of the separating body ends 54, 55 to the other separating body end 54, 55.

In the example shown, the body widths 57 of axially successive separating bodies 38 decrease alternately from the first body end 54 to the second body end 55 and vice versa. In the example specifically shown, the body width 57 of the end separating body 38" decreases continuously from the first separating body end 54 to the second separating body end 55. In the case of the intermediate separating body 38' which follows the end separating body 38" and which separates the first wall segment 56' from the second wall segment 56", the body width 57 increases continuously from the first separating body end 54 to the second separating body end 57. In the case of the axial subsequent intermediate separating body 38', which separates the second wall segment 56" from the third wall segment 56'", the body width 57 decreases continuously from the first separating body end 54 to the second separating body end 55. Thus, despite alternating winding directions 28, 29, dense and in particular gapless winding of the coil wire 30 on the respective wall segment 56 is possible. The decreasing body with 57 of the respective separating body 38 is, in the examples shown, realized by means of a profile, which has an angle $\alpha$ in the circumferential direction, of at least one axial flank 58 of the respective separating body 38. In the case of the end separating body 38" that is shown, at least one of the flanks 58 has such a profile, whereas, in the case of the intermediate separating bodies 38', both flanks 58 have such a profile.

It can be seen in particular from FIG. 20 that a spacing 59, running in the circumferential direction, between the separating body ends 54, 55 of the respective separating body 38, in particular of the respective intermediate separating body 38', is dimensioned and configured such that the coil wire 30, as it passes through the recess 53 and reverses the winding direction 28, 29, fills the recess 53 in substantially form-fitting fashion in the circumferential direction. It can also be seen that, in the respective recess 53, the separating body end 54, 55 against which the coil wire 30 bears owing to the inner contour 60 shaped by the reversal of the winding direction 28, 29 is that separating body end 54, 55 which has the smaller or minimum body width 57. In the example shown, therefore, in the case of the separating body 38' which separates the first wall segment 56' from the second wall segment 56", the first separating body end 54 is that which has the relatively small, in particular minimum, body width 57, whereas, in the case of the other intermediate separating body 38', the second separating body end 55 has the relatively small, in particular minimum, body width 57 of the intermediate separating body 38'. This, too, leads to easier winding of the coil wire 30, and to improved stability of the coil winding 30. It can also be seen that the separating body end 54, 55 against which the coil wire 30 bears with the inner contour 60 is of rounded form.

It can also be seen from FIG. 20 that a radially running extent of the respective separating body 38 corresponds substantially to a radial extent of the coil wire 30, such that the separating bodies 38 are aligned axially with the illustrated first row 31' of the coil wire 30, such that the row 31 of the coil wire 30 wound onto the first row 31' can be wound in gapless and dense fashion. In the examples shown, it is thus the case that a radial separating body height 61 (see FIG. 22) of the respective separating body 38 corresponds substantially to the radial dimension or extent of the coil wire 30.

A further exemplary embodiment of the coil body 16 is illustrated in FIG. 22. This exemplary embodiment differs from the exemplary embodiment shown in FIGS. 20 and 21 in that the flanks 58 of the separating bodies 38 each run in radially inclined fashion, and in the example shown each run so as to be inclined radially toward the other flank 58. The respective flank 58 thus forms an angle $\beta$ with the radial direction 51. Consequently, the body width 57 of the respective separating body 38 also decreases in the radial direction 51 away from the cavity 18. This permits, in particular, a more gapless and denser winding of the coil wire 30 onto the carrier wall 19, and simplified production of the coil carrier 16.

In the examples shown in FIGS. 20 to 22, the intermediate separating bodies 38' are arranged such that the second wall segment 56" is spaced apart axially from the core 22 and has been relocated toward the piston 12. Furthermore, the third wall segment 56'" is axially smaller than the first wall segment 56' and than the second wall segment 26". Accordingly, the second winding section 36 of the coil wire 30 wound in the second winding direction 29 is arranged so as to be spaced apart axially from the core 22 and so as to overlap the piston 12. It is self-evidently possible for the respective separating bodies 38, in particular intermediate separating bodies 38', to also run in an axially offset manner in order to change the position of the corresponding wall segments 56 or winding sections 35, 36, 37 relative to the core 22, to the piston 12 and to the axial gap 32.

The invention claimed is:

1. An electromagnetic switch for a starting device of an internal combustion engine, comprising:

a coil carrier having a carrier wall which extends in an axial direction and which encloses a cavity in the coil carrier;

a coil winding having a coil wire wound on a side of the carrier wall facing away from the cavity and which, during operation, is flowed through by an electrical current and provides a magnetic field within the cavity;

a piston which is axially adjustable in the cavity and, when the coil winding is not in operation, is disposed in a passive position and, during operation of the coil winding, is adjusted axially in a direction of a core;

in the passive position of the piston, the piston and the core defining an axial gap therebetween in the cavity;

the coil wire, in an axially extending first winding section, wound in a first winding direction around the carrier wall;

the coil wire, in an axially extending second winding section, wound in a second winding direction opposite the first winding direction around the carrier wall; and wherein at least one winding of the second winding section axially overlaps the axial gap.

2. The electromagnetic switch according to claim 1, wherein all windings of the second winding section axially overlap the axial gap.

3. The electromagnetic switch according to claim 1, wherein the second winding section axially adjoins the first winding section.

4. The electromagnetic switch according to claim 1, wherein:

the coil wire has a third axial winding section wound in the first winding direction around the carrier wall; and the second winding section is arranged completely between the first winding section and the third winding section relative to the axial direction.

5. The electromagnetic switch according to claim 4, wherein at least one of:

a side of the first winding section facing axially away from the second winding section is free from windings of the coil wire; and a side of the third winding section facing axially away from the second winding section is free from windings of the coil wire.

6. The electromagnetic switch according to claim 1, wherein:

the coil wire has a third axial winding section wound in the first winding direction around the carrier wall;

the carrier wall has a radial step such that, in a first wall section, the carrier wall has an outer diameter which is smaller than an outer diameter in a second wall section of the carrier wall that axially follows the first wall section, and the carrier wall has a chamber in the first wall section; and the coil wire is wound around the first wall section and around the second wall section such that:

the first winding section radially contacts the first wall section;

the second winding section radially contacts the second wall section proximal the radial step; and the third winding section radially contacts the second wall section on a side of the second winding section opposite the first winding section.

7. The electromagnetic switch according to claim 6, wherein a portion of the coil wire wound in the first winding direction fills the chamber.

8. The electromagnetic switch according to claim 6, wherein:

the coil wire has a non-ferromagnetic first wire section and a ferromagnetic second wire section; and the first wall section is disposed spaced apart axially from the core, and the second wire section is wound onto the first wall section.

9. The electromagnetic switch according to claim 1, wherein a pitch of the coil wire in the second winding section varies.

10. The electromagnetic switch according to claim 9, wherein the pitch decreases axially toward the core.

11. The electromagnetic switch according to claim 1, wherein:

the coil wire is wound in at least two radially successive rows around the carrier wall; and the second winding section is arranged in a row of the at least two rows that radially adjoins the carrier wall.

12. The electromagnetic switch according to claim 1, wherein the coil wire has a non-ferromagnetic first wire section and a ferromagnetic second wire section.

13. The electromagnetic switch according to claim 12, wherein the at least one winding of the second winding section that axially overlaps the axial gap is formed by the second wire section.

14. The electromagnetic switch according to claim 12, wherein the second winding section is formed by the second wire section.

15. The electromagnetic switch according to claim 12, wherein the second winding section is formed partially by the first wire section and partially by the second wire section.

16. The electromagnetic switch according to claim 12, wherein the second wire section is disposed spaced apart axially from the core.

17. The electromagnetic switch according to claim 1, further comprising a ferromagnetic bypass body surrounding the cavity and arranged radially between the cavity and the coil winding wherein:

in the passive position of the piston, the bypass body axially overlaps the axial gap; and at least one winding of the second winding section axially overlaps the bypass body.

18. The electromagnetic switch according to claim 17, wherein the bypass body axially overlaps the axial gap entirely.

19. A starting device for starting an internal combustion engine, comprising:

a starting element which, for starting of the internal combustion engine, engages with a counterpart starting element of the internal combustion engine;

an electromagnetic switch including:

a coil carrier having a carrier wall which extends in an axial direction and which encloses a cavity in the coil carrier;

a coil winding having a coil wire wound on a side of the carrier wall facing away from the cavity and which, during operation, is flowed through by an electrical current and provides a magnetic field within the cavity;

a piston which is axially adjustable in the cavity and, when the coil winding is not in operation, is disposed in a passive position and, during operation of the coil winding, is adjusted axially in a direction of a core;

the piston and the core defining an axial gap therebetween in the cavity when in the passive position of the piston;

the coil wire, in an axially extending first winding section, wound in a first winding direction around the carrier wall;

the coil wire, in an axially extending second winding section, wound in a second winding direction opposite the first winding direction around the carrier wall; and at least one winding of the second winding section axially overlapping the axial gap;

wherein the piston is connected to the starting element such that the piston, during the axial adjustment in the direction of the core, adjusts the starting element in the direction of the counterpart starting element.

20. An electromagnetic switch for a starting device of an internal combustion engine, comprising:

a coil carrier having a carrier wall which extends in an axial direction and which encloses a cavity in the coil carrier;

a coil winding having a coil wire wound on a side of the carrier wall facing away from the cavity and which, during operation, is flowed through by an electrical current and provides a magnetic field within the cavity;

a piston which is axially adjustable in the cavity and, when the coil winding is not in operation, is disposed in a passive position and, during operation of the coil winding, is adjusted axially in a direction of a core;

in the passive position of the piston, the piston and the core defining an axial gap therebetween in the cavity;

the coil wire, in an axially extending first winding section, wound in a first winding direction around the carrier wall;

the coil wire, in an axially extending second winding section, wound in a second winding direction opposite the first winding direction around the carrier wall;

wherein at least one winding of the second winding section axially overlaps the axial gap; and wherein a side of the at least one winding facing radially toward the axial gap, which axially overlaps the axial gap, is free from the coil wire.

* * * * *